US006129506A

United States Patent [19]

Hagenbuch

[11] Patent Number: 6,129,506

[45] Date of Patent: Oct. 10, 2000

[54] MATERIAL HANDLING PROCESS UTILIZING SPECIALIZED SUPER CONTAINERS AS FLOATING VESSELS/ BARGES

[76] Inventor: Leroy G. Hagenbuch, 502 W. Northgate Rd., Peoria, Ill. 61614

[21] Appl. No.: 08/950,829

[22] Filed: Oct. 15, 1997

[51] Int. Cl.[7] ..... B63B 25/02

[52] U.S. Cl. ..... 414/803; 414/137.7; 414/139.8

[58] Field of Search ..... 414/21, 137.8, 414/137.7, 138.7, 139.8, 139.9, 140.9, 142.6, 143.2, 803

[56] References Cited

U.S. PATENT DOCUMENTS

| | | | |
|---|---|---|---|
| 2,988,036 | 6/1961 | Mooneyhan et al. | 414/137.7 X |
| 3,280,997 | 10/1966 | Pioch | 414/421 X |
| 3,520,429 | 7/1970 | Andersson | 414/421 |
| 3,818,852 | 6/1974 | Lewis et al. | 414/138.7 X |
| 4,049,131 | 9/1977 | Schrader et al. | 414/139.9 |
| 4,898,112 | 2/1990 | McGlew et al. | 414/138.7 X |
| 5,526,766 | 6/1996 | Armstrong et al. | 114/343 |

FOREIGN PATENT DOCUMENTS

| | | | |
|---|---|---|---|
| 4316677 | 11/1993 | Germany | 414/137.7 |

OTHER PUBLICATIONS

"Shugart: Who We Are", Shugart Manufacturing, available to applicant in approximately Oct., 1997.

"Shugart: Barges", Shugart Manufacturing, available to applicant in approximately Oct., 1997.

*Primary Examiner*—Janice L. Krizek

*Attorney, Agent, or Firm*—Leydig, Voit & Mayer, Ltd.

[57] ABSTRACT

The invention relates to a process for moving and transporting materials utilizing specialized transporting containers. These containers, which can be transported over land utilizing specialized haulage equipment such as tractor-trailers or railroad "rail-trucks," can be floated and moved on water either as single units or as a large tow whereby a tugboat can move these containers on inland waterways and a short distance off shore into larger bodies of water where these containers would be loaded onto self-loading oceangoing transport ships for transport to some distant point for off-loading. Utilizing containers as floating transport vessels eliminates the need for extensive dockage and port facilities. Specifically, the process of the present invention may be employed wherever loaded containers can be put into the water, or alternatively loaded while they are in the water, and moved by tugboat to an oceangoing transport ship where the containers can be loaded onto oceangoing transport ships. Likewise, the floating containers filled with material can be dispatched at any offshore point for transiting by tugboats to shore where the containers are either unloaded while they are floating in the water or floated onto land transport vehicles for transit to some nearby land-based discharge or container unloading point.

27 Claims, 23 Drawing Sheets

MATERIAL HANDLING PROCESS UTILIZING SPECIALIZED SUPER CONTAINERS AS FLOATING VESSELS/ BARGES

FIELD OF THE INVENTION

The present invention relates to methods for transporting materials, and, more particularly, to a method for transporting bulk materials utilizing floating containers.

BACKGROUND OF THE INVENTION

Currently in the transport of materials, if that transport is land based, the amount of material that can be transported in any single load is limited to the land based infrastructure such as roads, bridges, underpasses and the like. Land based transport of any distance is typically either by truck or rail. By truck, the size of the load is limited by roadway restrictions. By railway, the size of loads is limited by the railway bed and railway infrastructure restrictions such as tunnels and bridges, i.e. width, height and weight of load and, at some point, length of load also impacts rail shipments. On rail, load length is not as important as it is for truck haulage. Water transport does not have the same degree of size limitations as does truck and rail transport, but water transport is limited by other factors that truck and rail transport are not.

Oceangoing water transport has historically been limited by the water depths available to dock oceangoing vessels. As such, oceangoing transport is typically limited to those geographical locations with suitable deep water port facilities. As for inland water transport of materials, river water depths have limited the size of vessels. The relatively shallow depth of inland waters has necessitated using conventional river barges to move material over inland waters to oceangoing ports. At these oceangoing ports, the material is then unloaded from the barges and either loaded directly onto oceangoing ships or the material is put in storage for later loading onto oceangoing ships. The limitations, as to where oceangoing vessels can dock and the corresponding depth of inland waters, makes the waterborne shipment of materials a logistically challenging process.

Geographical areas that do not have suitable port facilities have to ship their goods which are to be transported by oceangoing vessels to areas with suitable port facilities for transshipment to distant areas, and at these distant destinations unloading of material is limited to those areas with suitable port facilities where goods can be unloaded for shipment to their final land/inland destination. These limitations have necessarily and accordingly restricted the intercontinental movement of large amounts of materials to only those geographical areas with natural occurring port facilities.

Another disadvantage with water transport of bulk materials, such as grain, is that it is impossible to keep high quality product segregated from lower quality product. For example, grain for foreign sale or oceangoing shipment is often transported by river barge to an ocean port where the grain is unloaded into grain storage elevators. From the grain storage elevators, the grain is transferred to an oceangoing ship for transport to a foreign country. However, since all of the grain is transferred into grain storage elevators at the shipping port, any poor quality grain that has been transported to the port is mixed with the other grain. Mixing this poor quality grain with the higher quality grain lowers the value of the higher quality grain and prevents producers of higher quality grain from obtaining a premium on the sale of their grain.

SUMMARY AND OBJECTS OF THE INVENTION

The object of this invention is to allow the shipment and receiving of materials continentally or intercontinentally, from any geographical water served point without requiring the conventional infrastructure for port facilities and the expense associated with the development and maintenance of such ports.

It is also an object of the invention to load and unload shipments using water transport systems without restricting the loading and unloading points to ports that have traditional infrastructures for loading and unloading materials.

A related object of the invention is to free up oceanic shipments from having to be launched or landed at port facilities so that shipments may be launched or landed at any accessible land point with suitable water depth—i.e., six to ten feet Briefly, the invention employs floatable shipping containers that are preferably larger than a standard intermodal shipping container, but not as large as typical inland waterway barges, which can be loaded and unloaded without the need for the infrastructure of a port facility. Using conventional vehicles having custom container handler trailers, the containers are launched into and retrieved from the water. The custom container handler trailers can be equipped to rotate the shipping containers in order for their bulk loads to be quickly and easily dumped. Providing access to water based transportation without requiring the goods being shipped to be delivered to a port facility could enable, for example, commodities to be produced in particular regions that previously were hampered by the costs of transporting their commodities to the nearest port facilities. In particular, allowing for the launching of the containers at virtually any site along a shore may make it economically profitable to develop and transport commodities from previously undeveloped regions or underdeveloped sources. These commodities include coal, stone, minerals, grain, etc. that are may be available from sources which presently are not readily accessible to major ports.

The floating containers are preferably unsegmented and without compartments so as to maximize their capacity to hold bulk material. Each of the floating containers also can be built in a standardized style so that several containers can be configured into a group which has precisely predictable dimensions. As part of this standardized style, the height, length and width of each of the floating containers is typically substantially the same as all the other containers. Moreover, each of the floating containers can be built to allow for top loading of bulk material into the container. Each floating container is constructed to be water-tight for floating on any body of water with suitable draft or depth of water for the size and load of the floating container.

The floating containers can be loaded at any point on land, including any existing port facility, or they can be loaded while in the water. If a floating container is loaded on land, it can then be launched into the water using a custom container handler trailer. After they are in the water, the containers can then be floated by tugboats to an oceangoing container transport ship anchored off shore. A loading/unloading system on-board the ship then lifts the container from the water and places into a cargo bay of the ship. The containers are then transported by the ship to an intended destination. Once the oceangoing container transport ship anchors at the designated container debarkation point, the containers can be unloaded from the ship into the water, using the loading/unloading system on-board the ship. The containers can then be floated to shore with a tugboat and unloaded at the shoreline or taken out of the water for movement inland with a specialized container handler trailer similar to the trailer that launched the containers into the water at the originating transit point.

If the land movement of the containers from either the starting or termination point of material movement is a considerable distance from water, then the size of the containers may be limited by restrictions required to accommodate safe over land transportation of the floating container. Ideally, if a large amount of material is to be moved, the floating containers would be "super-sized" containers, meaning each of them would be similar in size to four standard intermodal shipping containers—i.e., two wide and two high.

These and other features and advantages of the invention will be more readily apparent upon reading the following description of a preferred exemplified embodiment of the invention and upon reference to the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
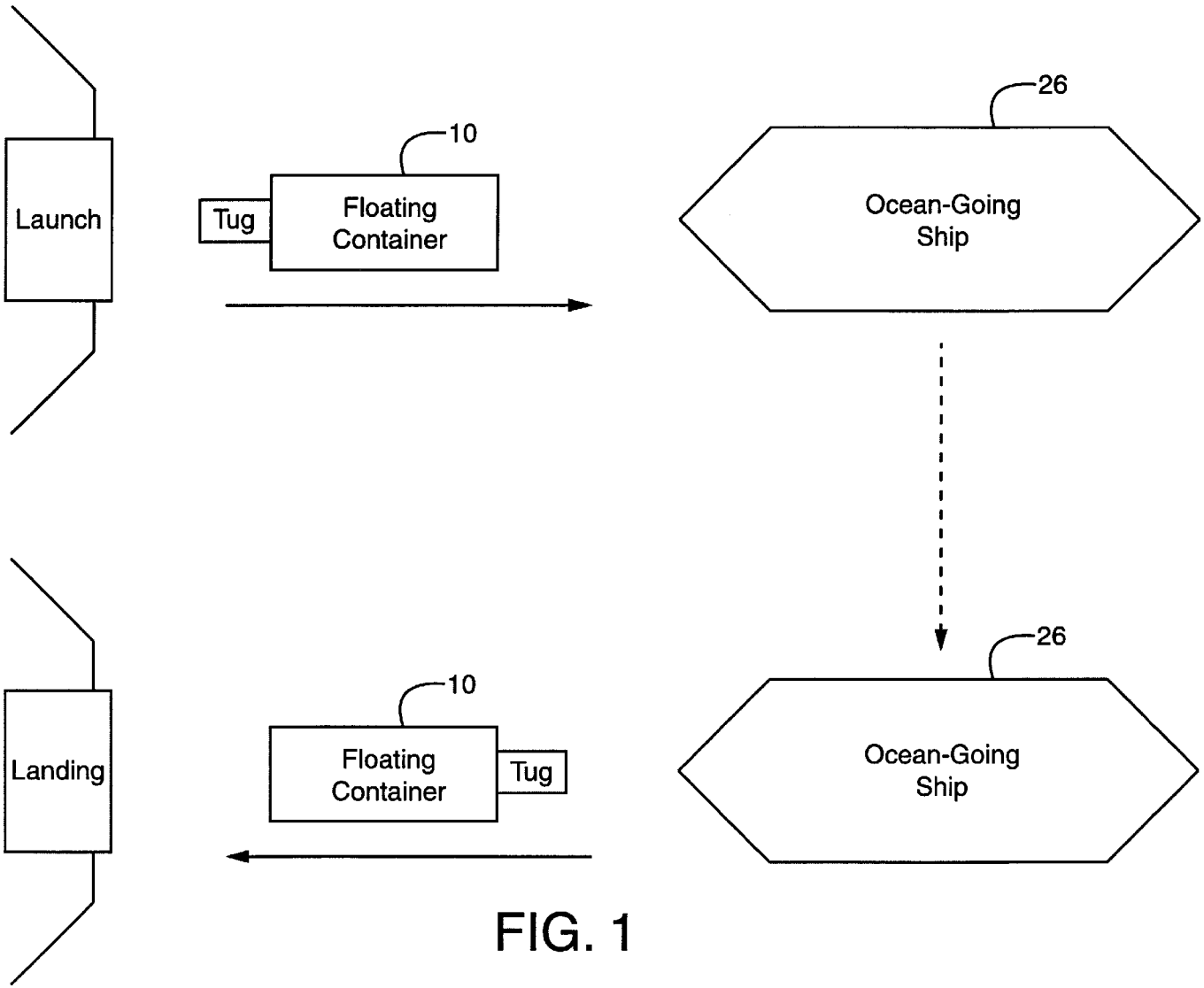
FIG. 1 is a schematic representation of the method of the invention in which a floating container carrying bulk material is launched from shore, floated to an oceangoing vessel, loaded onto the vessel, transported by the oceangoing vessel to a remote shore, unloaded from the vessel into the water and floated to the shore where its contents are then either immediately unloaded or unloaded after the container is moved inland.

Referring to FIG. 1, there is shown a schematic representation of the method of the present invention. As shown, in FIG. 1 the method of the present invention generally comprises launching at least one floating container filled with a bulk material, such as waste, coal, stone, minerals, grain, etc., from a point on the shoreline and transporting the floating container via a tugboat or the like to an oceangoing transport vessel or ship. The floating container is then loaded onto the oceangoing ship and transported to a remote location where the container is unloaded into the water and floated to shore via a tugboat or the like. Once the container reaches the shore at the remote location the bulk material may be either immediately unloaded or unloaded after the container is moved inland.

This method provides several significant advantages over known methods for transporting bulk materials. In particular, the use of water transport avoids many of the size and weight limitations that are associated with land-based transportation methods such as truck or rail. In addition, the use of floating containers eliminates the need for much of the costly infrastructure associated with port facilities. The method of the present invention also provides for much greater flexibility with respect to the location of both the launch and land points for shipments and the loading and unloading points of the bulk materials. In fact, with the present invention it is possible to launch and/or land ocean shipments from any accessible land location with a suitable water depth, typically six to ten feet, or from existing dock or port facilities. Moreover, the material can be loaded and unloaded into the floating containers either on land or while they are in the water. Accordingly, it is anticipated that the method of the present invention will make water-based transport of materials to distant locations much more convenient and economical, thereby making it a viable transportation option in many more situations where previously the costs and time constraints associated with such water-based transport have been prohibitive.

The first step of the method of the present invention comprises loading the material 12 into floating containers 10. This loading operation can take place at virtually any location including at an inland facility, on an existing dock or port facility or in the water. Moreover, conventional equipment can be used to perform the container loading operation. Accordingly, the advantages of water-based transport are achieved without the need to construct or use the extensive infrastructure normally associated with port facilities. The floating containers 10 are constructed to be water-tight to ensure buoyancy in a body of water. Preferably, the containers 10 are provided with a standard configuration consisting of four solid side walls and a solid floor with an open top through which the material 12 may be loaded as shown in FIGS. 2–6. In addition, the floating containers 10 may be double walled in order to provide more structural integrity. While this construction ensures the water tight integrity of the containers 10, it will be appreciated that containers having rear loading doors could be used so long as appropriate water-tight door seals were provided. Preferably the containers are larger in size than a standard intermodal shipping container but smaller than a typical barge used on inland waterways. In order to maximize the ability of the containers 10 to hold bulk materials, it is preferable that the containers do not have any segments or compartments. The containers 10 also must be constructed such that when fully loaded with whatever particular material they may be called upon to carry, they will have a draft which is suitable for use in the range of water depths in which they will be operating. The containers 10 also could be constructed to standardized dimensions such that several containers could be arranged together, for storage or transport or the like, in a group which would have precisely predictable dimensions. Providing the containers 10 with such standardized dimensions also would be of particular importance to the design of any specialized equipment that may be needed to handle the floating containers 10.

Figure 2:
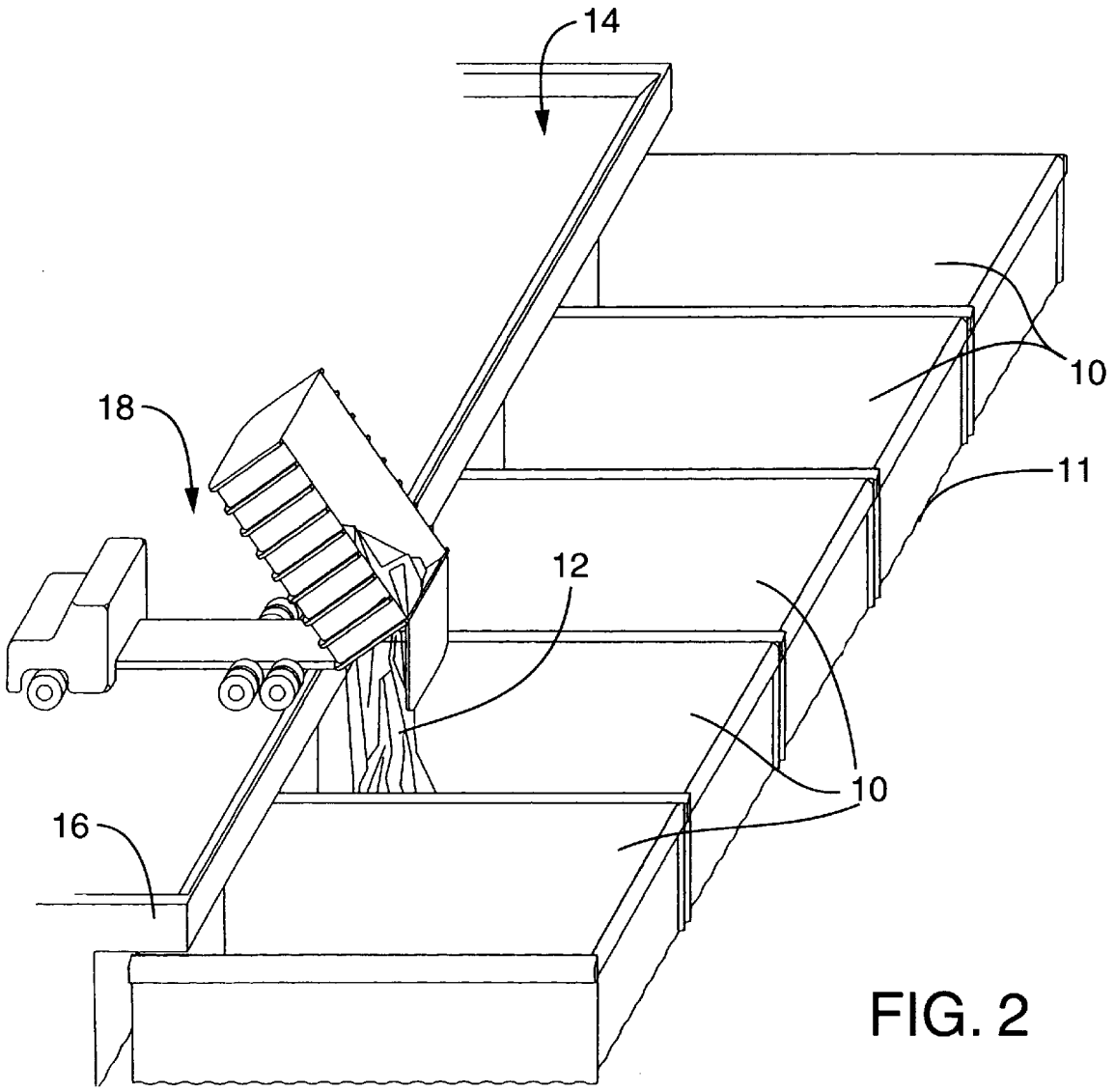
FIG. 2 illustrates a group of the floating containers tied up to a dock at the launch site in FIG. 1, in which one of the containers is receiving a load of bulk material from a normal over-the-road haulage vehicle backed up to a position over the container so that the load of bulk material can simply be dumped into the container.
Figure 3:
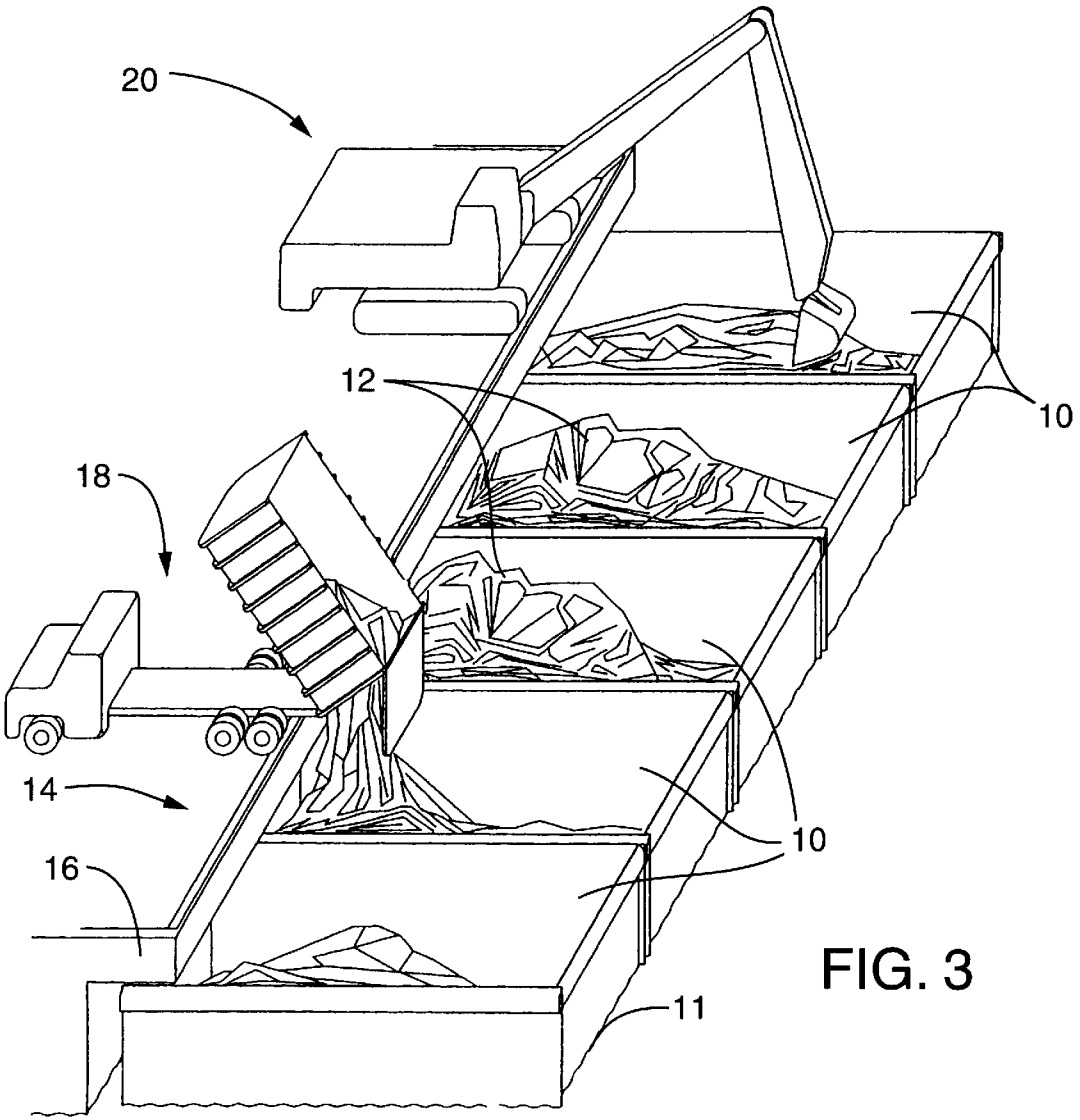
FIG. 3 illustrates the group of floating containers of FIG. 2 tied to a dock with material being dumped into them as a piece of conventional material handling equipment levels, packs and evenly distributes material in the containers.
Figure 4:
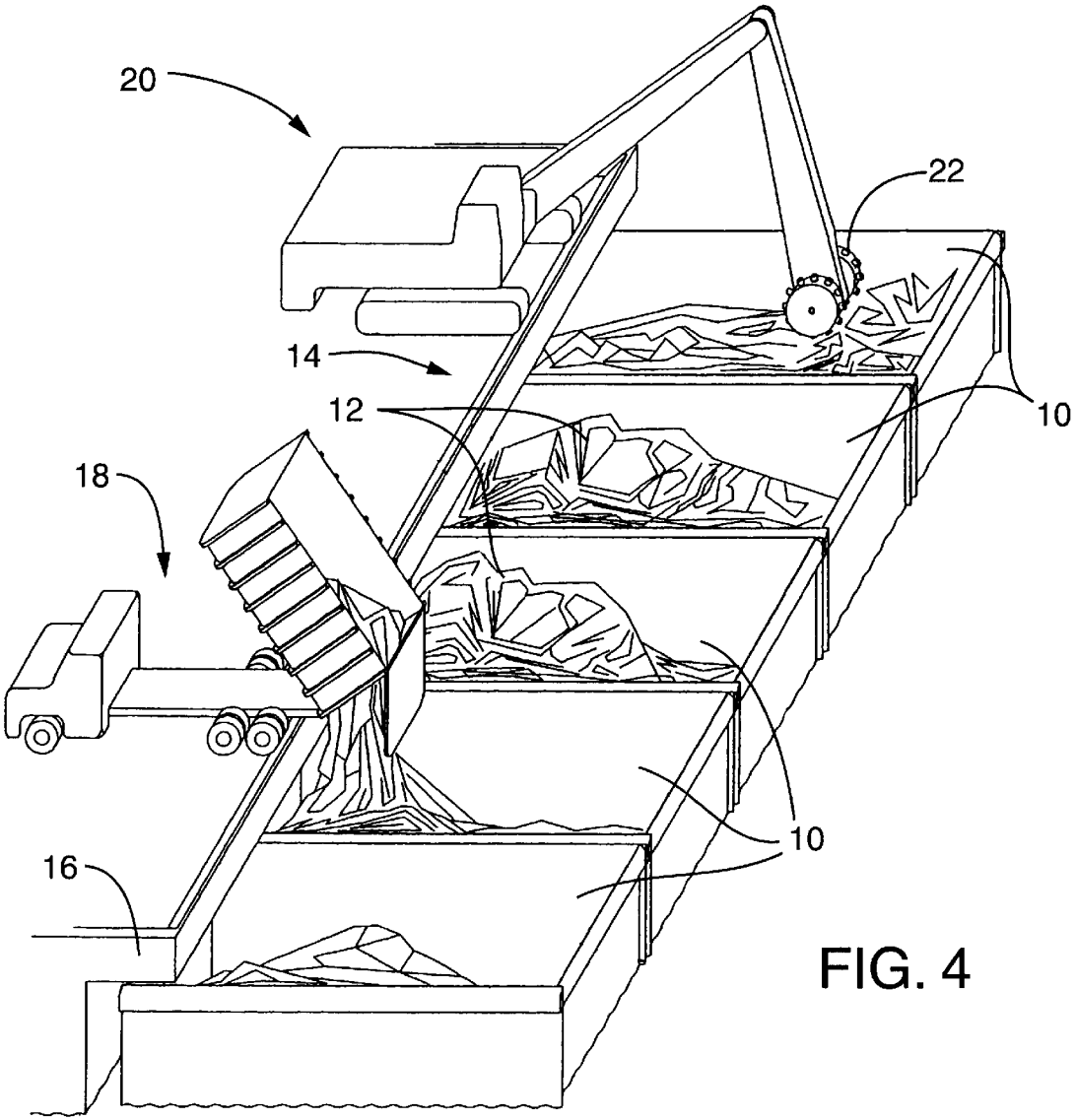
FIG. 4 illustrates the group of floating containers of FIG. 3 tied to a dock with material being dumped into them as a piece of conventional material handling equipment uses a compaction tool to compact and move the material in the containers.
Figure 5:
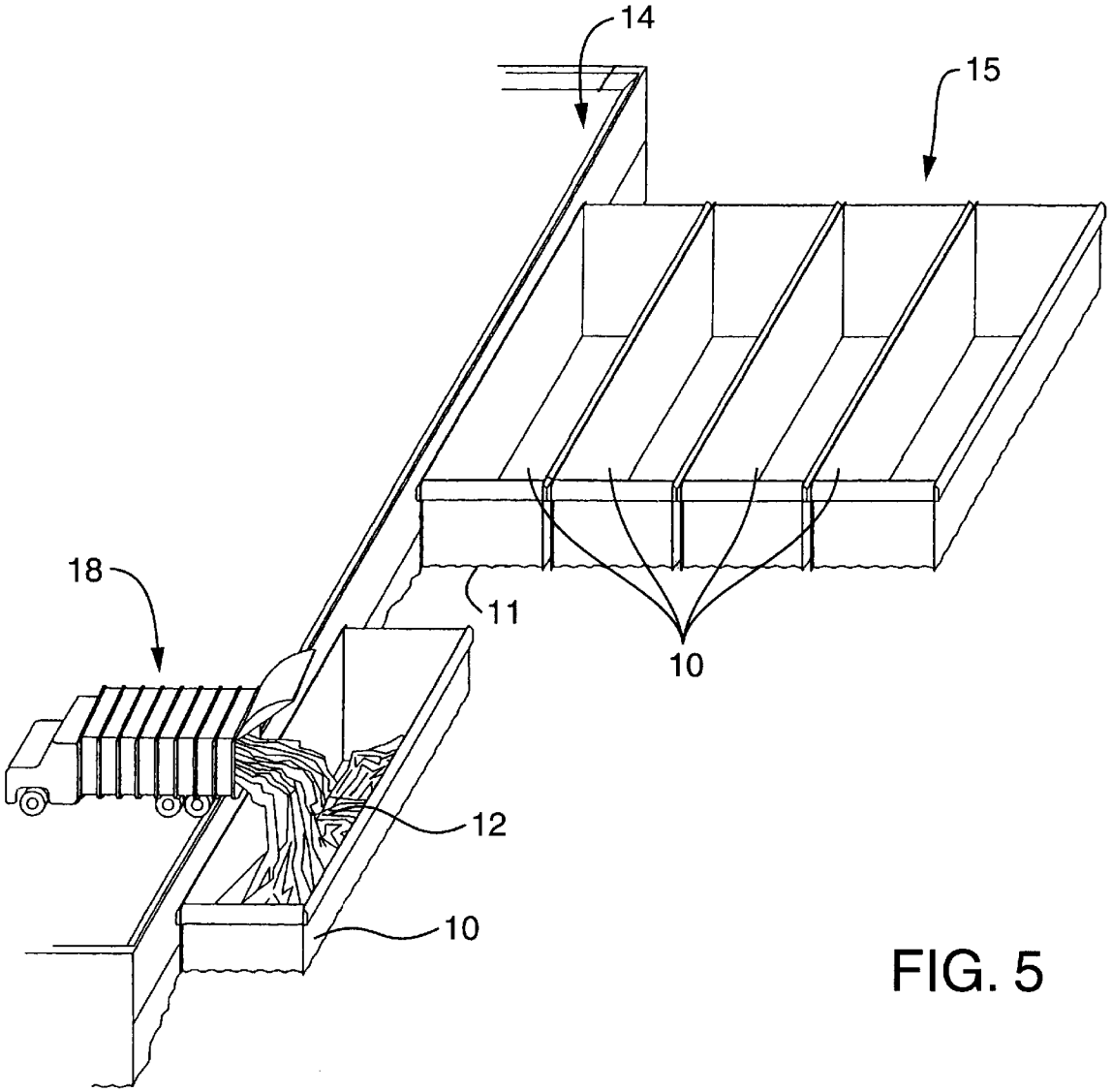
FIG. 5 illustrates a group of floating containers with one container tied up lengthwise along the dock with a conventional highway truck ejecting a load of material into the container.
Figure 6:
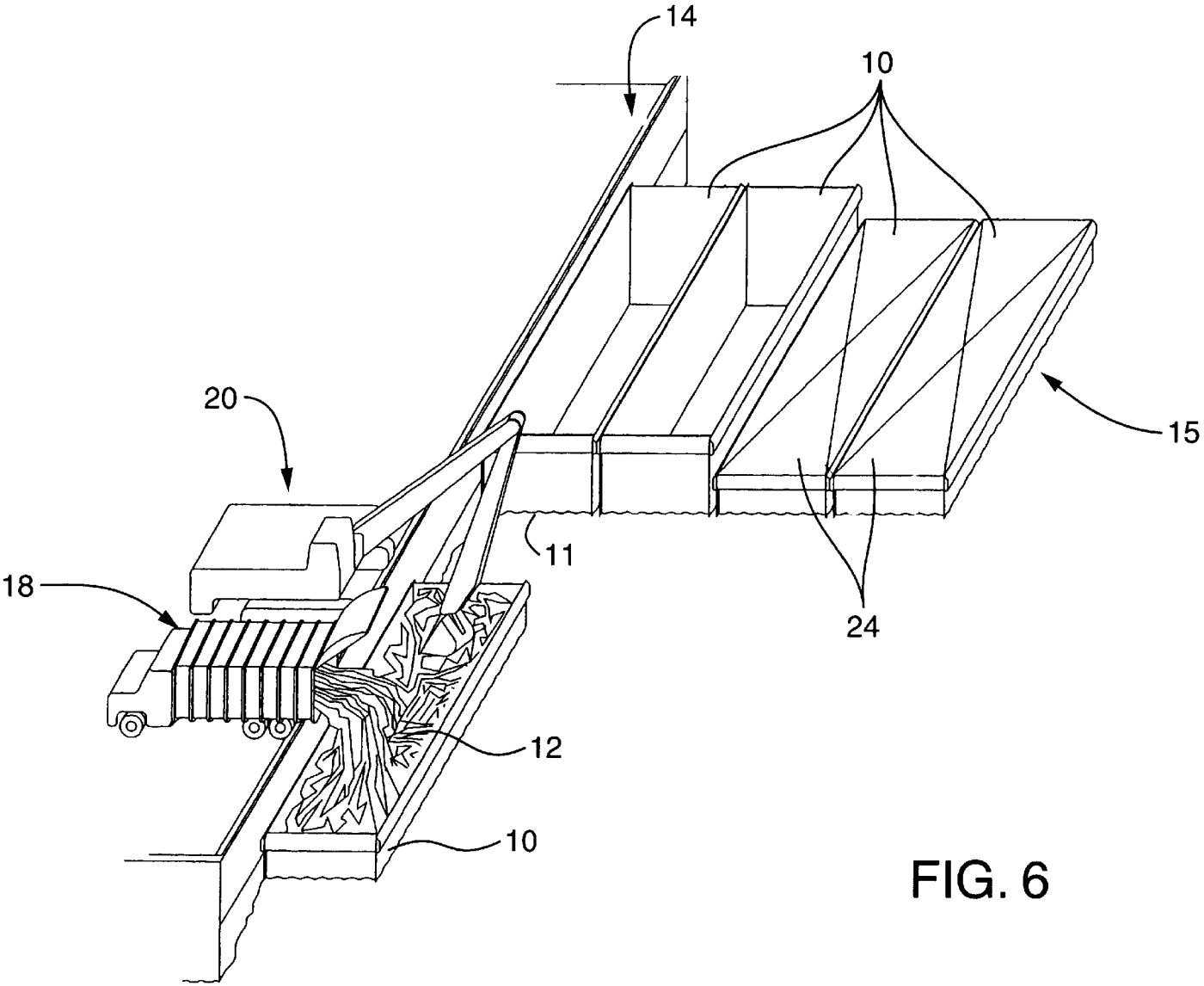
FIG. 6 illustrates one of the containers of FIG. 5 with a piece of conventional material handling equipment leveling, packing and distributing the material in the container as the container is being loaded.
Figure 7:
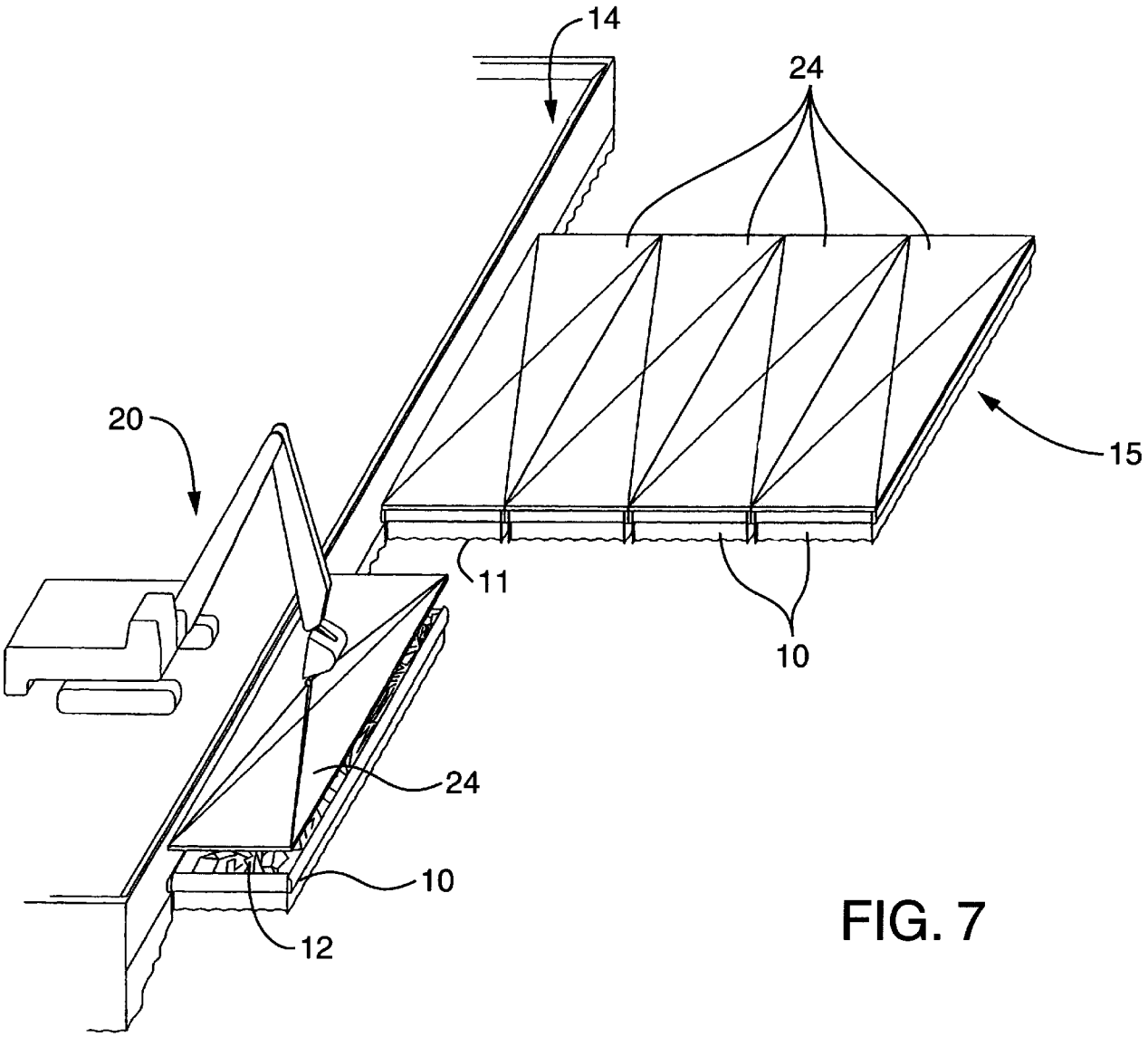
FIG. 7 illustrates the container of FIG. 6 loaded with material and a lid being placed on the top of the container using a piece of conventional material handling equipment.

In order to begin the loading operation, the floating containers 10 are moved from a marshaling or staging area to the loading area. If the floating containers 10 are to be loaded while they are in the water, generally referenced as 11, the loading area may comprise an existing dock 14 as shown in FIGS. 2–7. If such an existing dock 14 is used for loading the containers 10, the staging area, generally referenced as 15, for the floating containers could be located in the water 11, as shown in FIGS. 5–7, and a tugboat could be used to move the floating containers 10 to and from the dock 14 for the loading operation. As shown in FIGS. 2–6, conventional over the road haulage vehicles can be used to simply dump the material 12 off the dock 14 and into the floating container 10. In particular, as shown in FIGS. 2–4, the dock 14 may be equipped with an overhanging portion 16 which would allow a conventional over-the-road haulage vehicle 18 to dump the material 12 directly into the floating container 10. While an overhanging portion 16 is desirable, it is not necessary to enable the material to be dumped directly from a dock 14 into a floating container 10 in the water as shown in FIGS. 5–6.

The over-the-road haulage vehicle 18 may be a conventional dump truck (shown in FIGS. 2–4) or it may comprise simply a conventional truck with the material being ejected out of an open rear door and into the container 10 (shown in FIGS. 5–6). It will be appreciated that any number of different types of vehicles can be used to load the material 12 into the floating containers 10 and that one of the advantages of the present invention is that it allows for the use of conventional haulage-loading equipment.

Figure 20A:
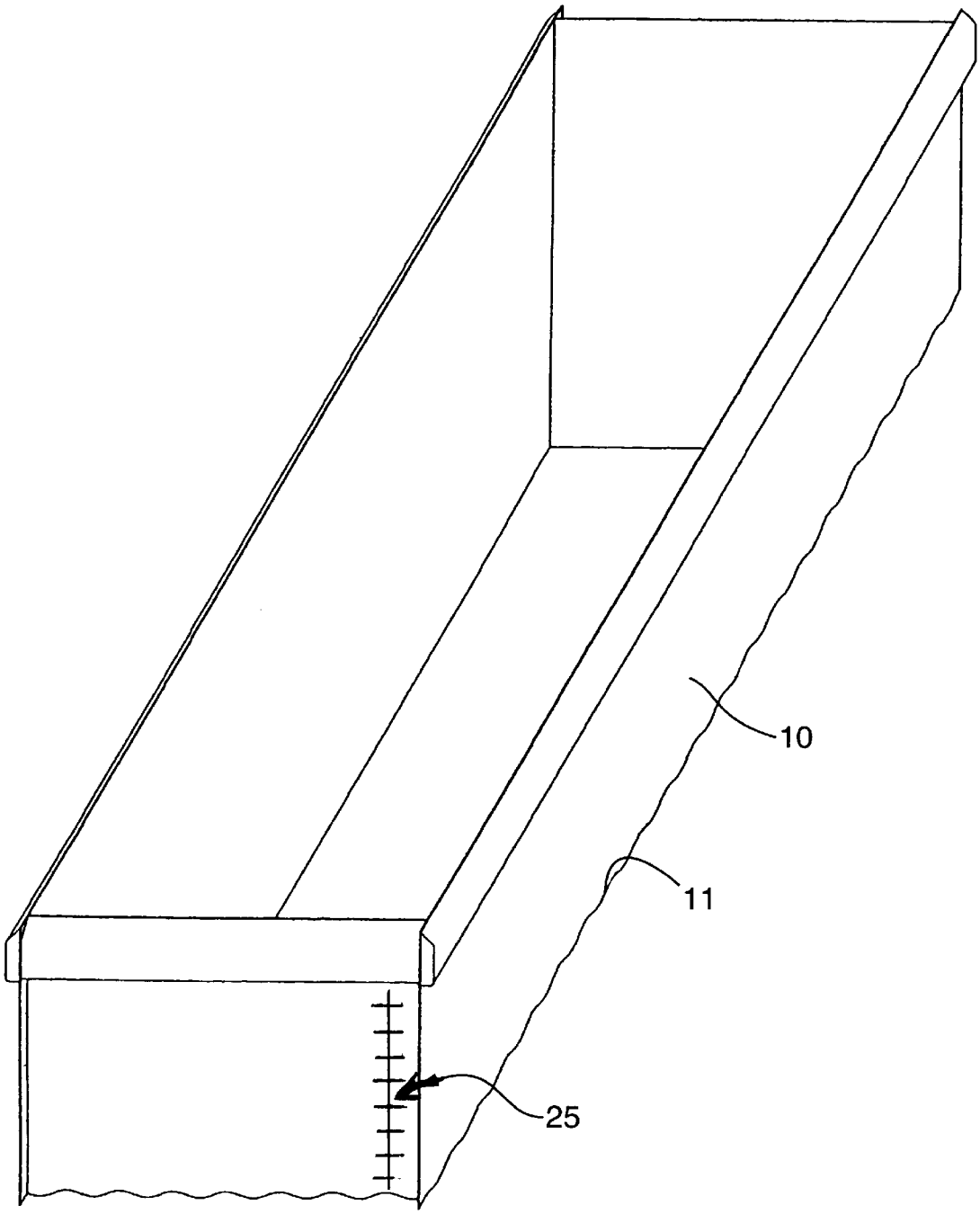
FIGS. 20A and 20B illustrate a floating container empty and a floating container loaded, respectively, which demonstrates the different drafts of the empty and loaded containers.
Figure 20B:
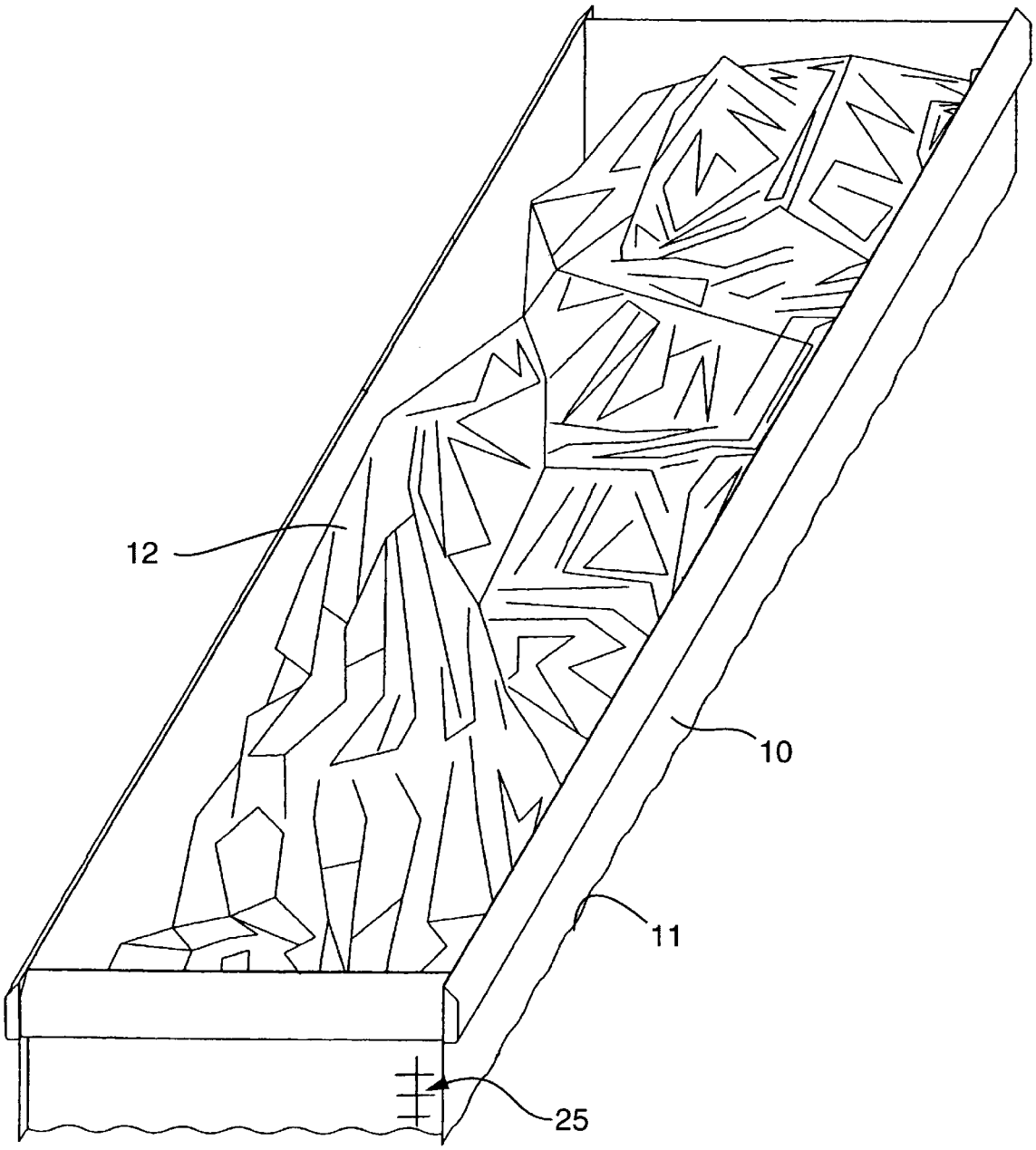

Another advantage of the use of floating containers 10 is that the draft of the floating container 10 in the water 11 can be used to determine the weight of the material 12 loaded in the container. As shown in FIGS. 20A and 20B, the floating container 10 rides much higher in the water 11 when it is empty (FIG. 20A) than when it is full (FIG. 20B). This change in the draft of the floating container 10 as its loaded can be used to determine the weight of the material 12 loaded in the container 10. This determination of the weight of the material through the draft of the floating container 10 can be facilitated by providing a scale 25 or some other indicia on at least one of the exterior walls of the floating container 10 as shown in FIGS. 20A and 20B.

Once the material 12 is in the floating container, a conventional piece of material handling equipment 20 may be used to level and otherwise evenly distribute the material 12 in the container 10 as shown in FIGS. 3, 4 and 6. The piece of material handling equipment 20 may also be equipped with a compaction tool 22 which could be used to compact the material into the containers 10 as shown in FIG. 4. The loading operation may be conducted with several floating containers 10 tied up alongside the dock 14 as shown in FIGS. 2–4 or with only a single floating container 10 tied up at the dock 14 as shown in FIGS. 5–6. Moreover, as desired, the floating containers 10 can be arranged lengthwise alongside the dock 14 for the loading operation (FIGS. 5–6) or they may be arranged perpendicular to the dock 14 (FIGS. 2–4). Similarly, the piece of material handling equipment 20 can be used to level and distribute the material 12 in those floating containers 10 that have already been filled (see FIGS. 3–4) or the piece of material handling equipment 20 could be used to level and distribute the material 12 at the same time it is being dumped into the container 10 as shown in FIG. 6.

Figure 19:
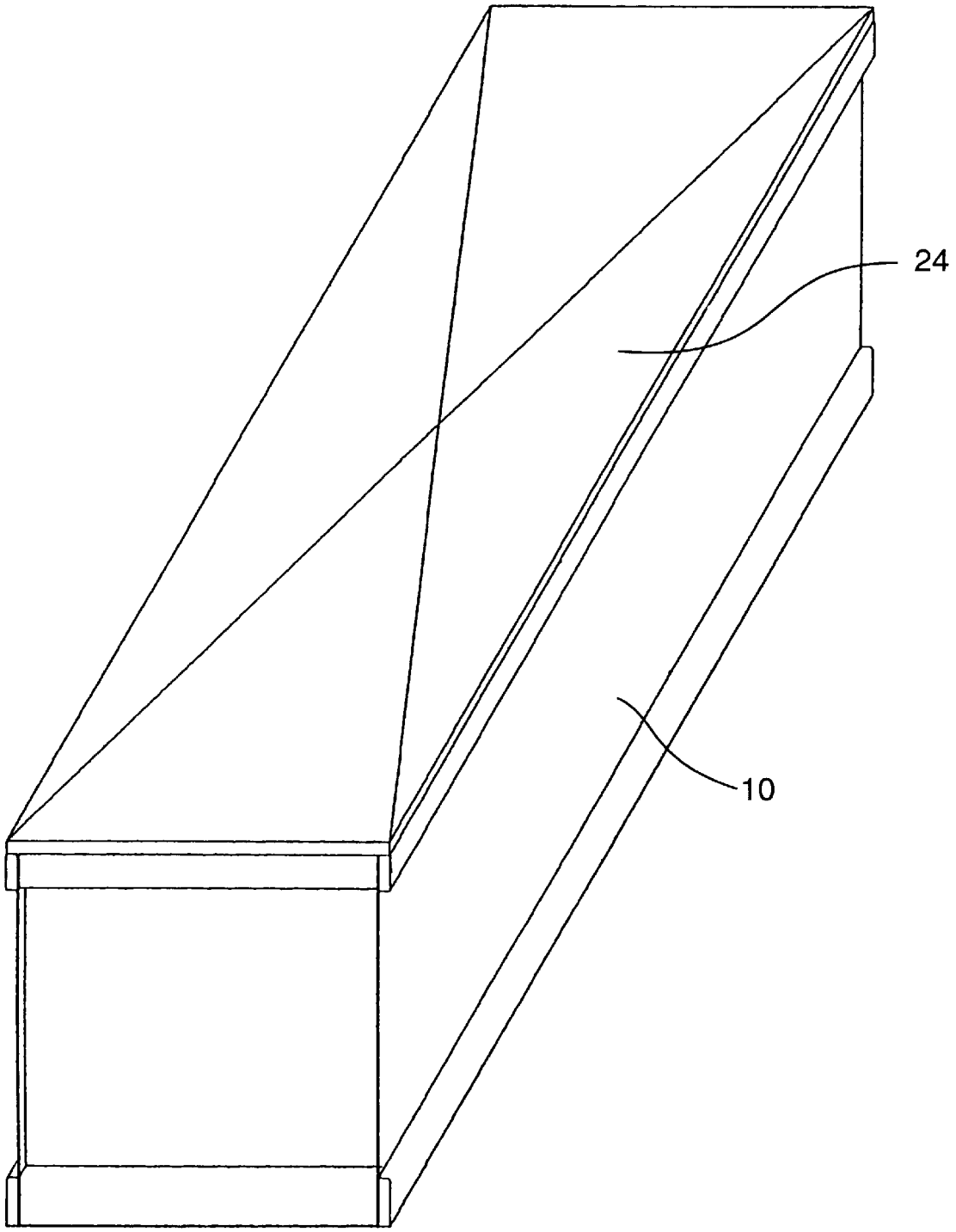
FIG. 19 is a perspective view of one of the containers with its lid in place.

Once the floating containers 10 have been filled, a lid 24 may be placed on the top of the floating container 10 in order to cover the container for transport. FIG. 19 provides a perspective view of a floating container 10 with its lid 24 in place. As shown in FIG. 7, the lid 24 can be placed on top of the floating container 10 through the use of the piece of material handling equipment 20. In order to ensure quality control, once the floating container is filled, a tamper-proof mechanical seal (not shown) may be applied to the container 10. The mechanical seal or the floating container 10 itself could also be provided with some source identifying mark, such as a number, which would enable the contents of the container to be easily tracked as it moves to its final destination. In order to facilitate automating the method of the present invention, machine readable indicia could be used to mark the containers 10. This ability to track the container 10 and its contents and identify its source would enable high quality bulk products, such as for example grain, to be kept segregated from lower quality grain, thereby increasing the price which the supplier of the higher quality material will be able to get for his/her goods. After the lid 24 has been placed on the container 10 after completion of the loading operation, the filled floating container 10 may then be moved back to the staging area 15 via a tugboat or the like as shown in FIGS. 5–7.

While the loading operation has been described in connection with dumping material from an existing dock into floating containers 10 which are already in the water, it will be appreciated that other types of loading operations could also be used in connection with the method of the present invention. For example, the floating containers 10 could be loaded on land, either at the port facility or at a more remote inland location, and then transported to a launch point along the shore, which could be virtually any accessible land point with suitable water depth, where the floating containers would be placed in the water. A specialized container handling trailer which is adapted such that it could be used both to transport the containers to the shore and launch the containers into the water is described in detail below. This flexibility of the method for loading the material into the containers, the location of the container loading operation, and the location where the containers are launched into the water is one of the significant advantages of using floating containers in accordance with this invention.

As noted above, once the floating containers 10 are fully loaded and placed in the water 11, they can be moved to a staging area 15 to await transport to an oceangoing transport ship 26 which typically is anchored a distance off-shore. Of course, it will be understood that the loaded floating containers 10 could be moved to the transport ship 26 as soon as they are placed in the water 11 or they may be kept in the staging area 15 either until a transport ship arrives or until a certain number of loaded containers 10 accumulate. As shown in FIG. 1, the loaded floating containers 10 can be moved to the transport ship 26 via tugboats. As will be appreciated, while the transport ship 26 sometimes is described herein as an oceangoing vessel, the transport ship 26 can be virtually any type of cargo ship which is capable of carrying a plurality of the floating containers 10 over a large body of water such as an ocean, lake or river.

Figure 8:
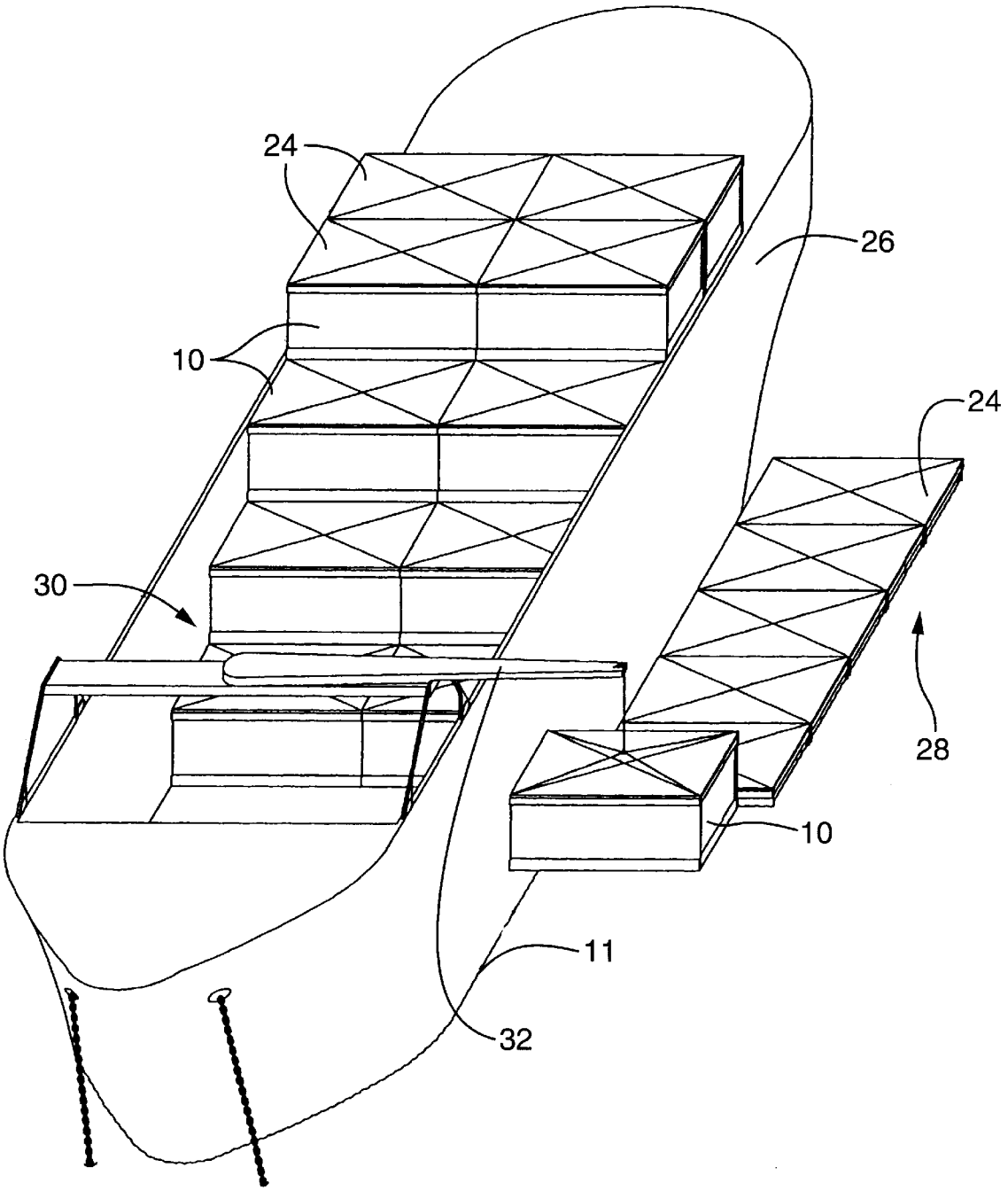
FIG. 8 illustrates a tow of loaded containers alongside an oceangoing transport ship with a loading mechanism on-board the ship for lifting the loaded containers from the water and placing the containers into the hold of the ship.

In order to facilitate transport of the floating containers 10 to the transport ship 26, several of the floating containers may be secured together in a conventional manner with ropes or the like to form a container barge-like tow 28. One example of such a container barge-like tow 28 is shown arranged alongside a transport ship 26 in FIG. 8. A specialized add-on nose or bow (not shown) could also be added to the container barge like tow 28 in order to provide for added ease of movement through the water 11. As shown in FIG. 8, once the loaded floating containers 10 reach the transport ship 26 they are lifted from the water 11 into a cargo bay or hold 30 of the transport ship 26 through a loading/unloading mechanism 32 which is provided on-board the transport ship 26. In the illustrated embodiment, the loading/unloading mechanism 32 comprises a pivotable crane which is capable of loading the floating containers 10 one-at-a-time into the cargo hold 30 of the ship. In order to facilitate the storage of the floating containers 10 in the transport ship 26, the transport ship and, in particular, the cargo hold 30 may be specially adapted for holding containers of this type. Storing the individual loaded floating containers 10 themselves in the cargo hold 30 of the transport ship, as opposed to emptying the contents of the containers 10 into the cargo hold 30, ensures that the material in the individual containers is kept segregated from material in the other containers. This ensures that higher quality materials are kept segregated from lower quality goods. In addition, storing the individual loaded floating containers 10 in the cargo hold 30 of the transport ship 26 offers significant advantages with respect to unloading the material at its ultimate destination as will be described in detail below. However, in some circumstances, it may be preferable to dump the bulk material from the floating containers 10 into the cargo hold 30 of the transport ship 26.

Figure 9:
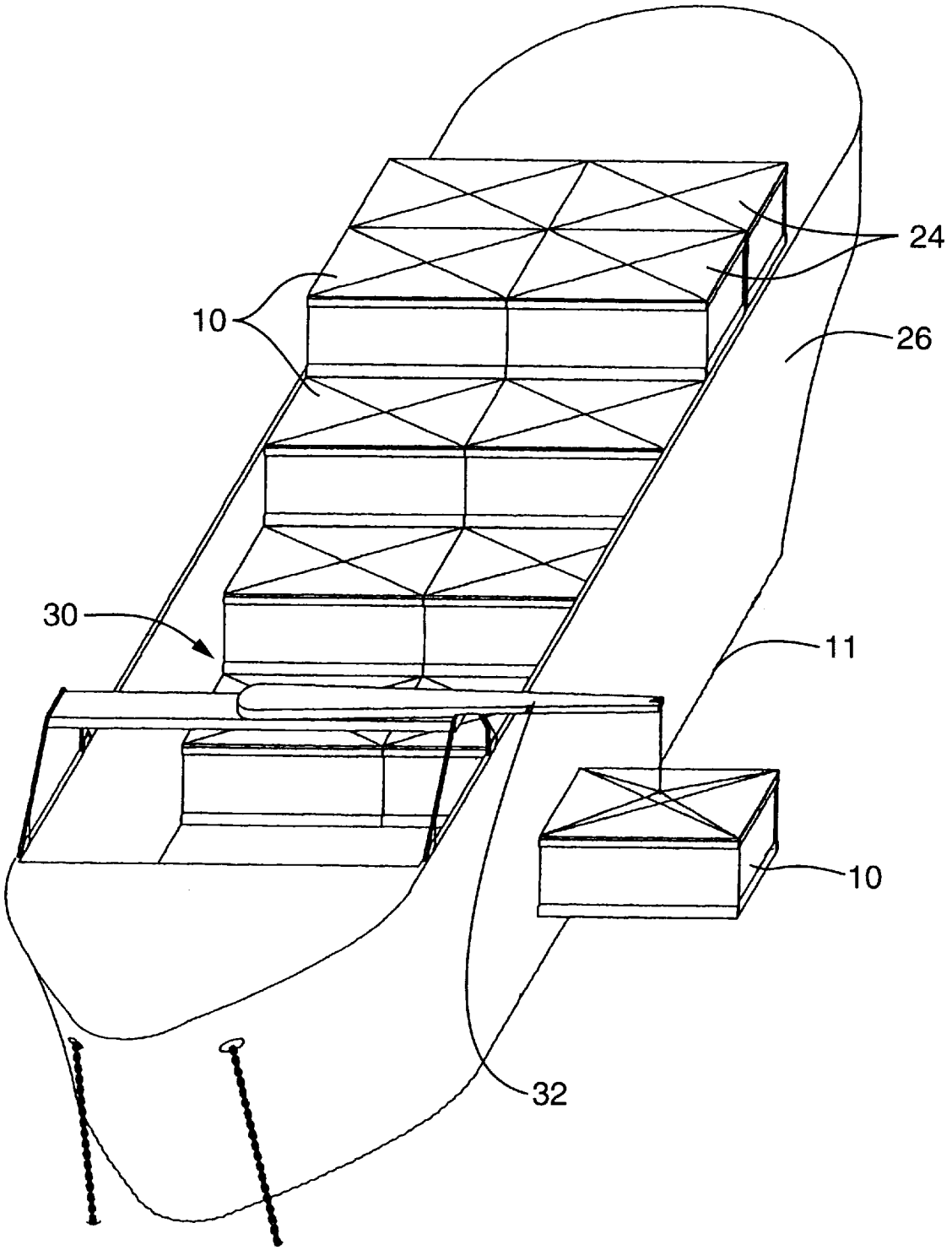
FIG. 9 illustrates the transport ship of FIG. 8 after it has reached its destination unloading the containers one at a time from its hold and into the water for floating to a landing point at a shore.

Once the floating containers 10 are loaded into the cargo hold 30 of the transport ship 26, the ship 26 then transports the floating containers to their intended destination. Of course, the individual containers may all have the same destination or the transport ship 26 may make several stops to unload particular containers at various destinations. At the intended destination, the loading/unloading mechanism 32 is used to unload the floating containers 10 from the cargo hold 30 and to place the containers back into the water 11 as shown in FIG. 9. Since the containers 10 can simply be placed in the water 11 after they are removed from the cargo hold 30, the potential destinations for the various containers are not limited to locations which have traditional port or dock facilities. Rather, the transport ship 26 can simply be anchored off-shore at a particular destination with the containers 10 being unloaded directly into the water 11 for movement to the shore.

Once the floating containers 10 are back in the water 11, a tugboat can be used to move the floating containers 10 to the landing point on the shore, as shown in FIG. 1, where the containers may be unloaded at the shoreline or removed from the water 11 for transport to an unloading point at a distance inland. If the floating containers 10 are to be unloaded at the shoreline all that is needed is some conventional material handling equipment (not shown) which could operate simply from an existing dock in much the same manner as described above in connection with the loading of the floating containers. Alternatively, if the destination point was an existing port facility, the floating containers 10 could be removed from the water 11 using a crane or the like and the material removed from the containers on shore at the port. However, if an existing port facility or dock is not available at a particular destination, the flexibility obtained from using the floating containers 10 enables the containers to be removed from the water at a landing point which does not have the traditional infrastructure associated with port or dock facilities. All that need be provided is a specialized container handling trailer 34, shown in FIGS. 10–14, which is adapted to remove the floating containers 10 from the water and transport them to an inland unloading/dumping point. Accordingly, the only requirements for the landing point for the floating containers 10 are that it be generally accessible to such a container handler trailer 34 and that there be a suitable water depth for the container handler trailer 34 to remove the floating containers 10 from the water 11.

Figure 10:
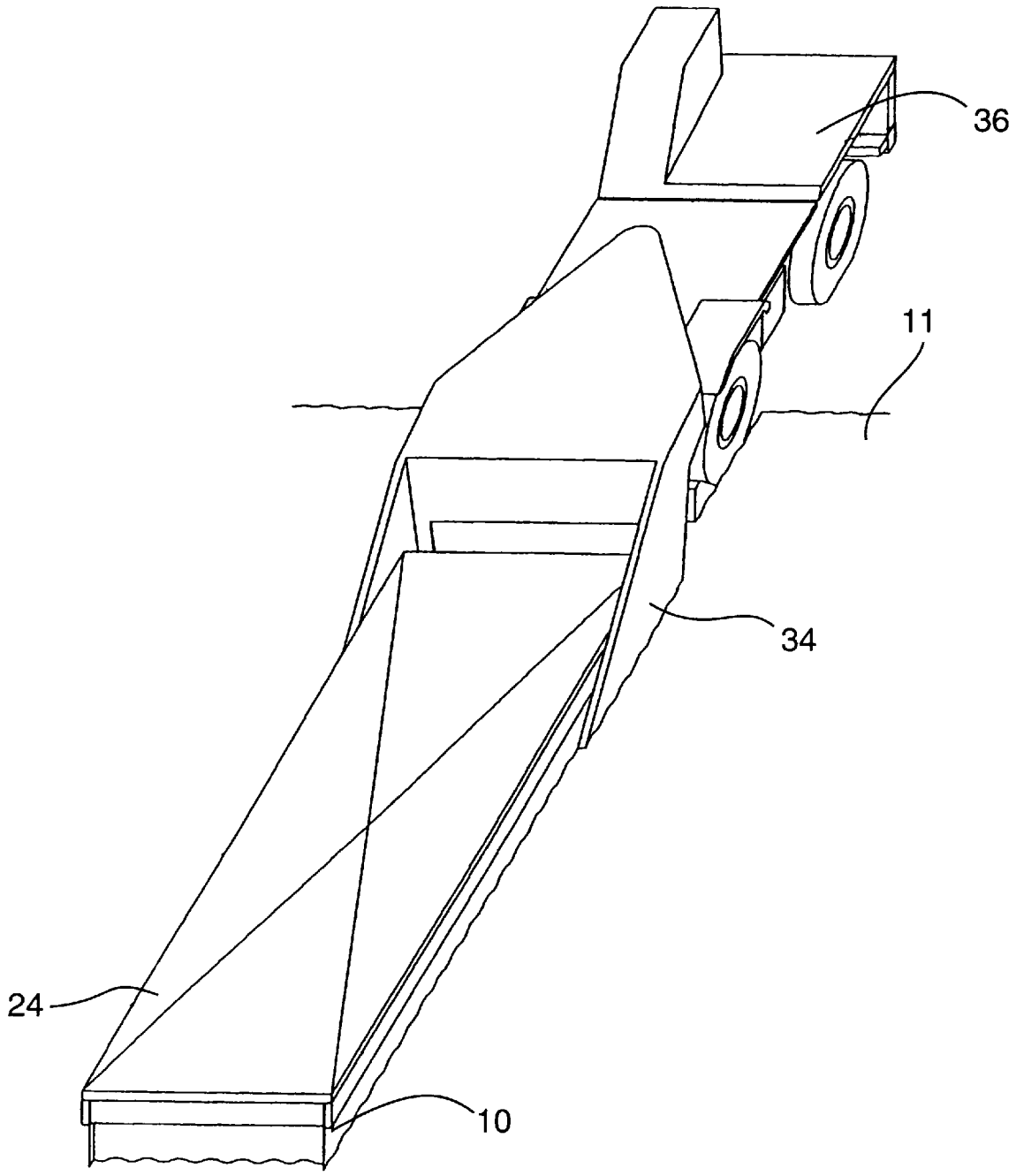
FIG. 10 illustrates a loaded container being removed from the water with a specialized container transport tractor-trailer after it has been floated to the landing at the destination shoreline.
Figure 11:
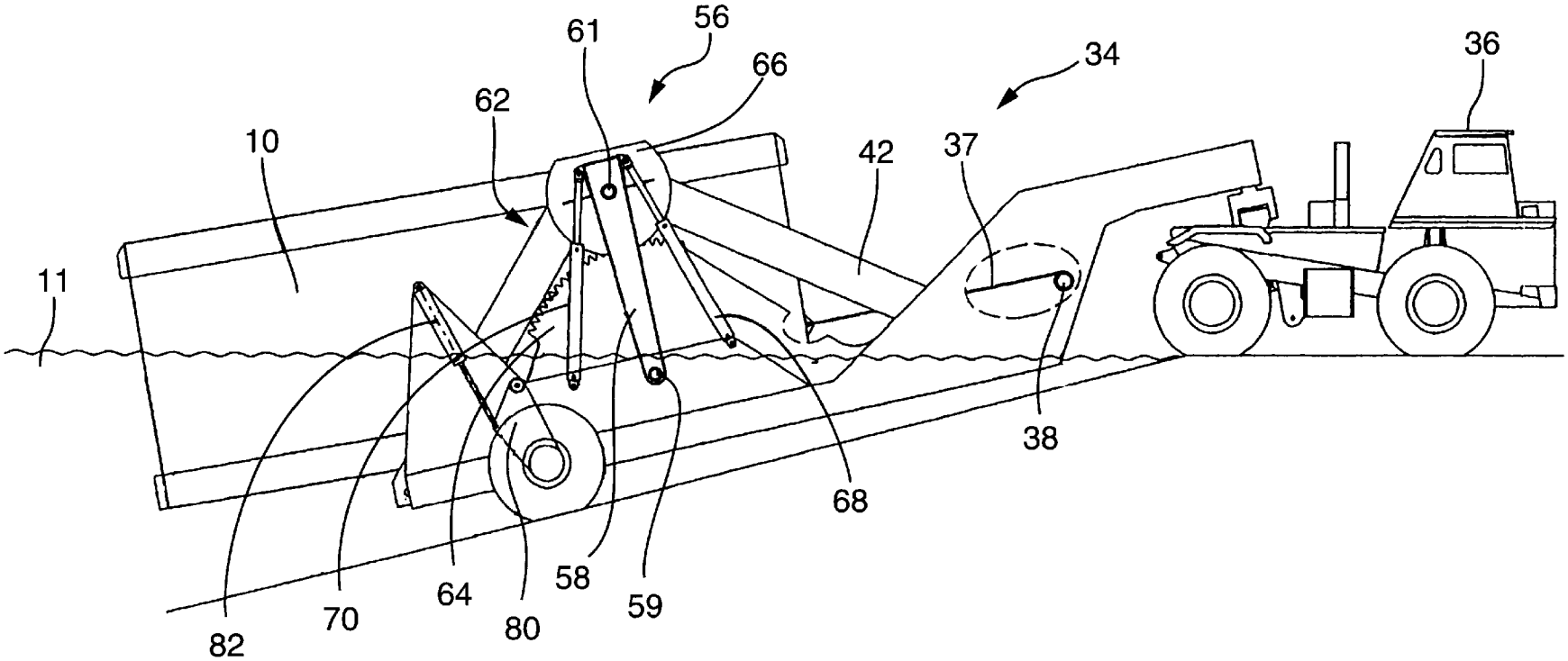
FIG. 11 is a side view which illustrates the loaded container being pulled onto a specialized container handler trailer.
Figure 12:
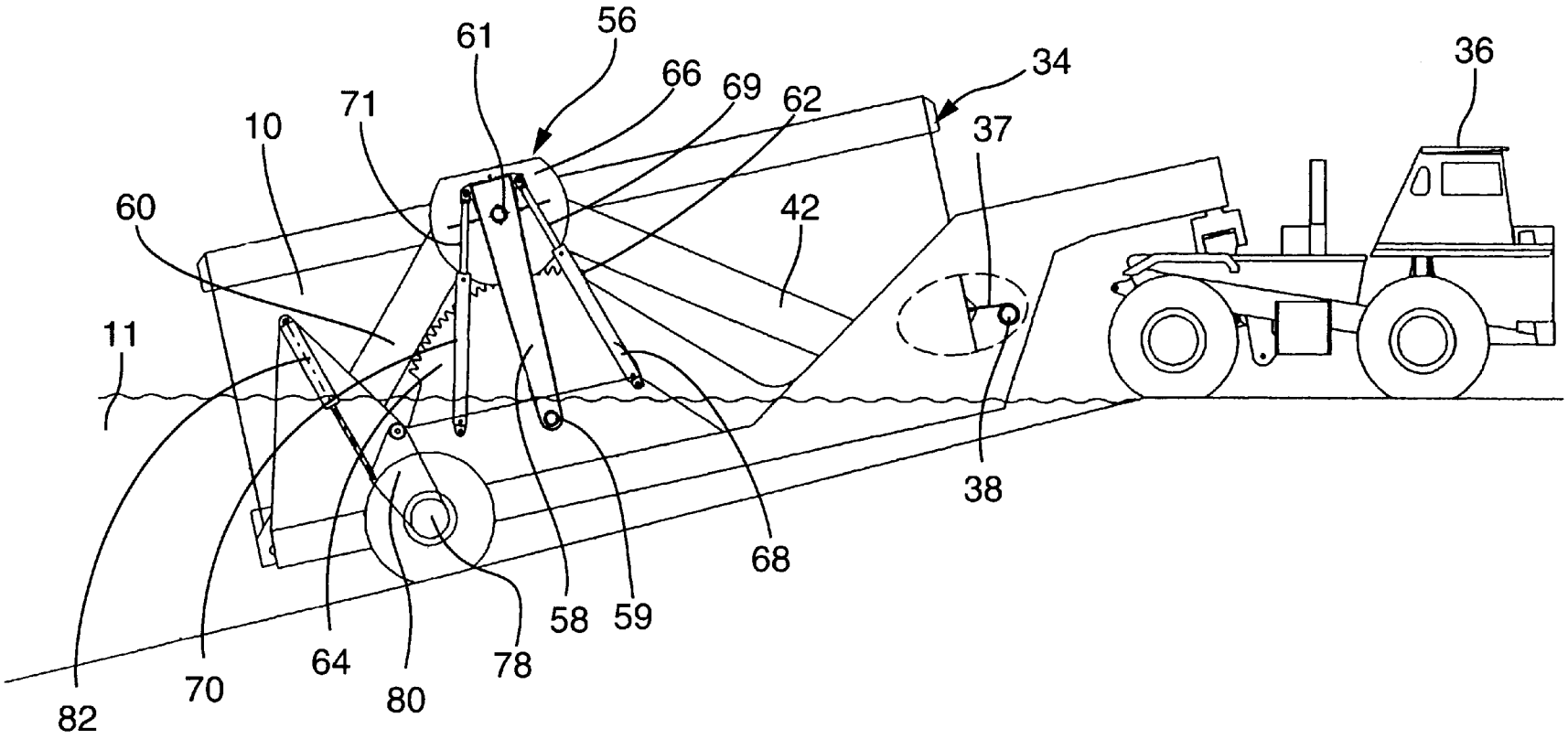
FIG. 12 illustrates the loaded container of FIG. 11 pulled filly into the transport position on the specialized container handler trailer of FIG. 11.

Referring to FIGS. 10–14 there is shown one preferred embodiment of a container handler trailer 34 which is adapted to remove a floating container 10 from the water 11, transport the floating container 10 inland and dump the contents of the container 10. As shown in FIG. 10, the container handler trailer 34 may be connected to a conventional heavy vehicle or tractor 36 such that the container handler trailer 34 can be backed into the water in order to pull a floating container 10 out of the water 11. In order to facilitate pulling the floating container 10 onto the container handler trailer 34, the container handler trailer 34 may be equipped with a cable 37 and winch 38 arrangement. After the container handler trailer 34 is backed into the water, the cable 37 can be connected to one end of the floating container 10, as shown in FIG. 11, and then the winch 38 may be actuated to pull the container 10 out of the water and into a transport position (FIG. 12) on the container handler trailer 34. Rollers 40 (shown in FIG. 14) may be provided on the bottom surface of a container cradle 42 on the container handler trailer 34 in order to ease the pulling of the floating container 10 onto the container handler trailer 34. As shown in the side view of FIG. 11, the container cradle 42 has an A-frame configuration which is adapted to receive and carry the floating containers 10.

Figure 21:
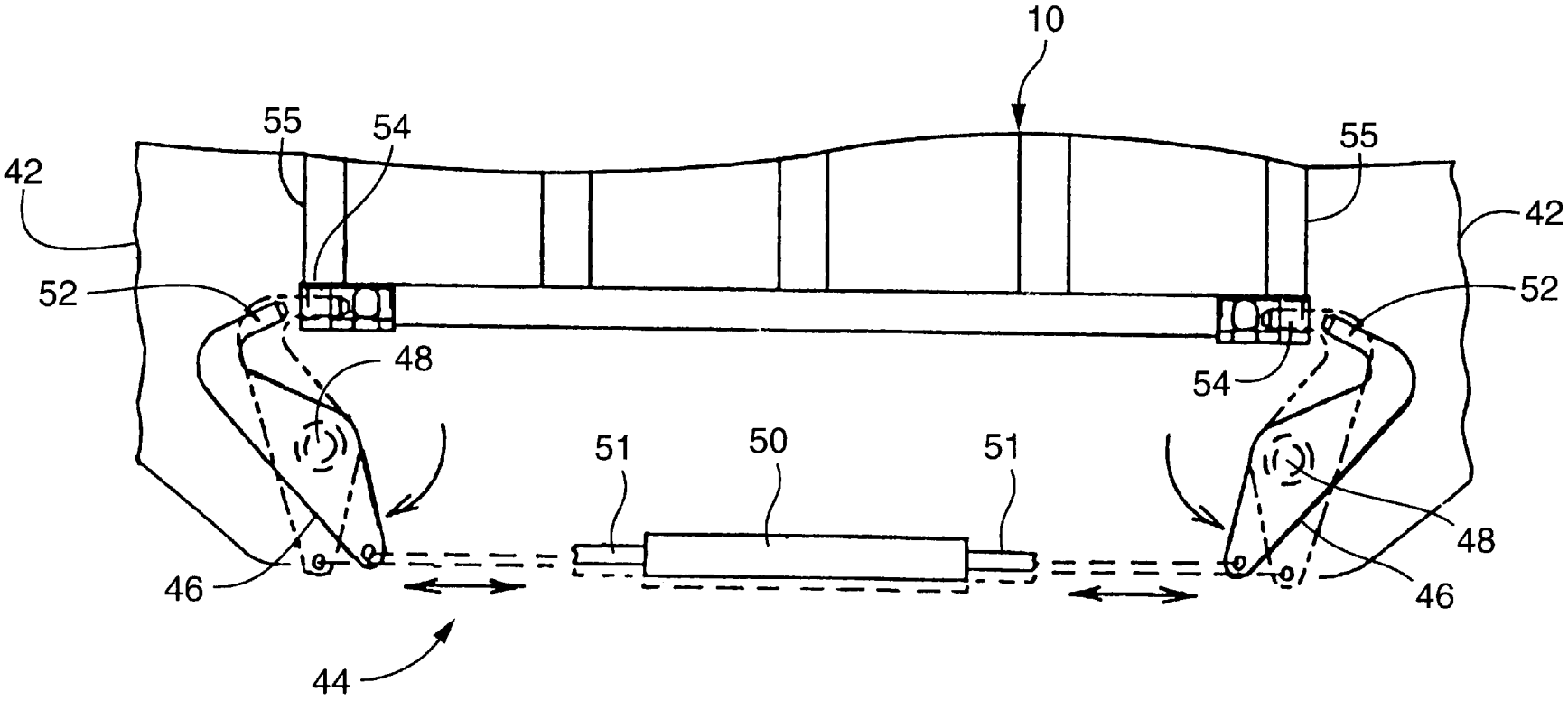
FIG. 21 is an enlarged partial schematic end view of one embodiment of a locking assembly for use with the container handler trailer of FIG. 11 showing the unhooked position of the container locking assembly in solid lines and the hooked position of the container locking assembly in broken lines.

Once the floating container 10 is secured in the container cradle 42, the tractor 36 can be used to pull the container handler trailer 34 with the floating container 10 out of the water. In order to prevent movement or shifting of the floating containers 10 relative to the container cradle 42 during transport and dumping, the container cradle 42 may be equipped with a plurality of hooking or locking assemblies 44. FIG. 21 illustrates one embodiment of such a hooking or locking assembly. As shown in FIG. 21, each locking assembly 44 comprises a pair of laterally spaced hook members 46, a pair of laterally spaced pivot pins 48 and a hydraulic actuating cylinder 50. The hook members 46 are pivotally attached by the pivot pins 48 to the container cradle for movement between hooked (shown in broken lines in FIG. 21) and unhooked positions (shown in solid lines in FIG. 21). In the unhooked position, the hook ends 52 of the hook members are located outside of the body of the container cradle 42 so as to not interfere with the loading of the floating containers 10 onto the container handler trailer 34. In the hooked position, the hydraulic cylinder 50 has extended such that the hook ends 52 engage hooking slots 54 that are provided in the side walls 55 of the floating containers 10. The hook ends 52 rotate between the hooked and unhooked positions in response to extension and retraction of the piston rods 51 of the hydraulic cylinder 50. Alternatively, each hook member 46 could be actuated by its own hydraulic cylinder. The location of the hooking slots 54 on the floating containers 10 can be standardized so as to ensure that the hooking slots 54 will be in the same position relative to the container cradle 42 for each individual floating container 10. A container handler having similar locking assemblies and other similar features is disclosed in U.S. application Ser. No. 08/589,264 U.S. Pat. No. 5,795,031 filed Jan. 22, 1996 and entitled "Top-Dumping Container Handler," the contents of which are hereby incorporated herein by reference.

Figure 13:
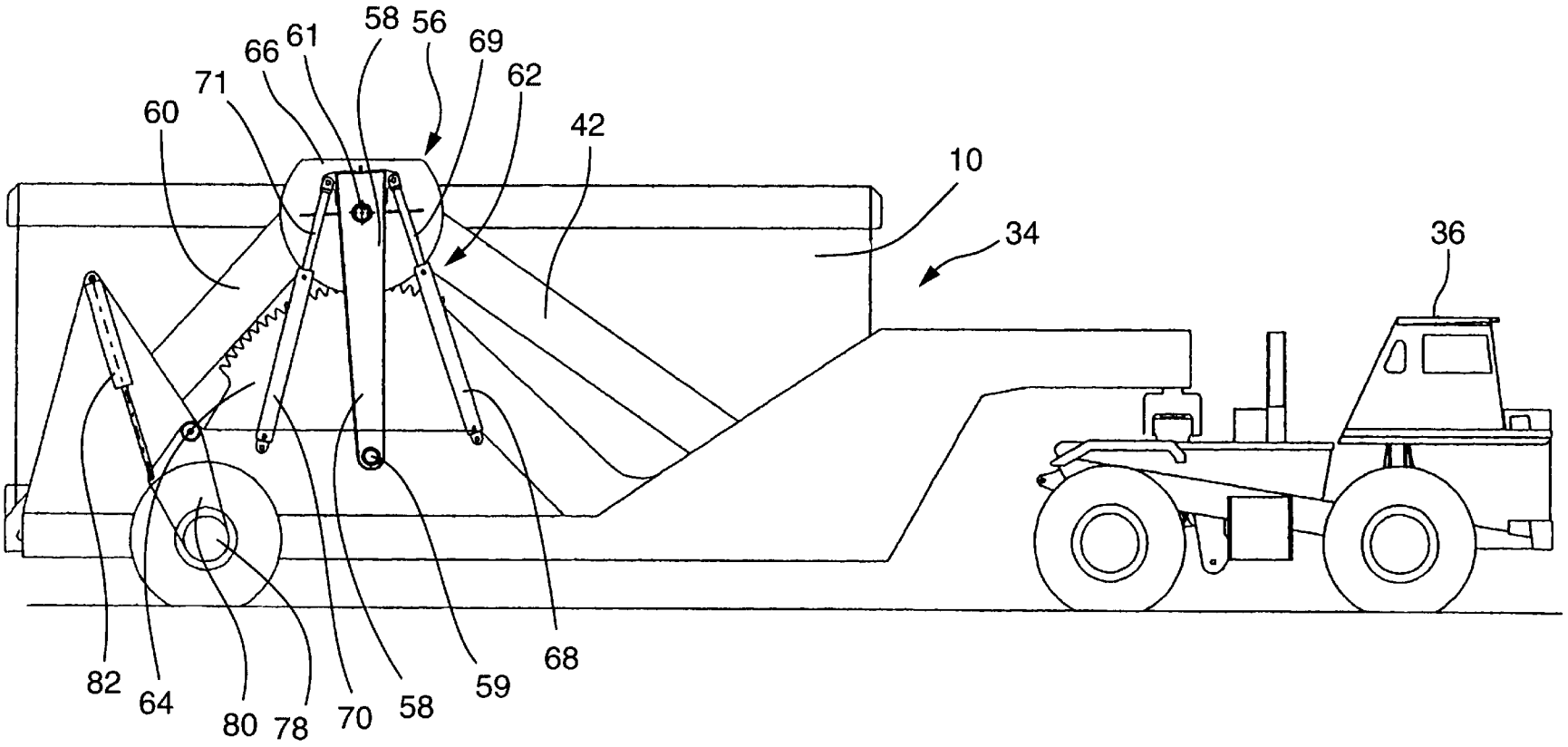
FIG. 13 illustrates the specialized container handler trailer of FIG. 11 transporting the loaded container to a dumping area.
Figure 14:
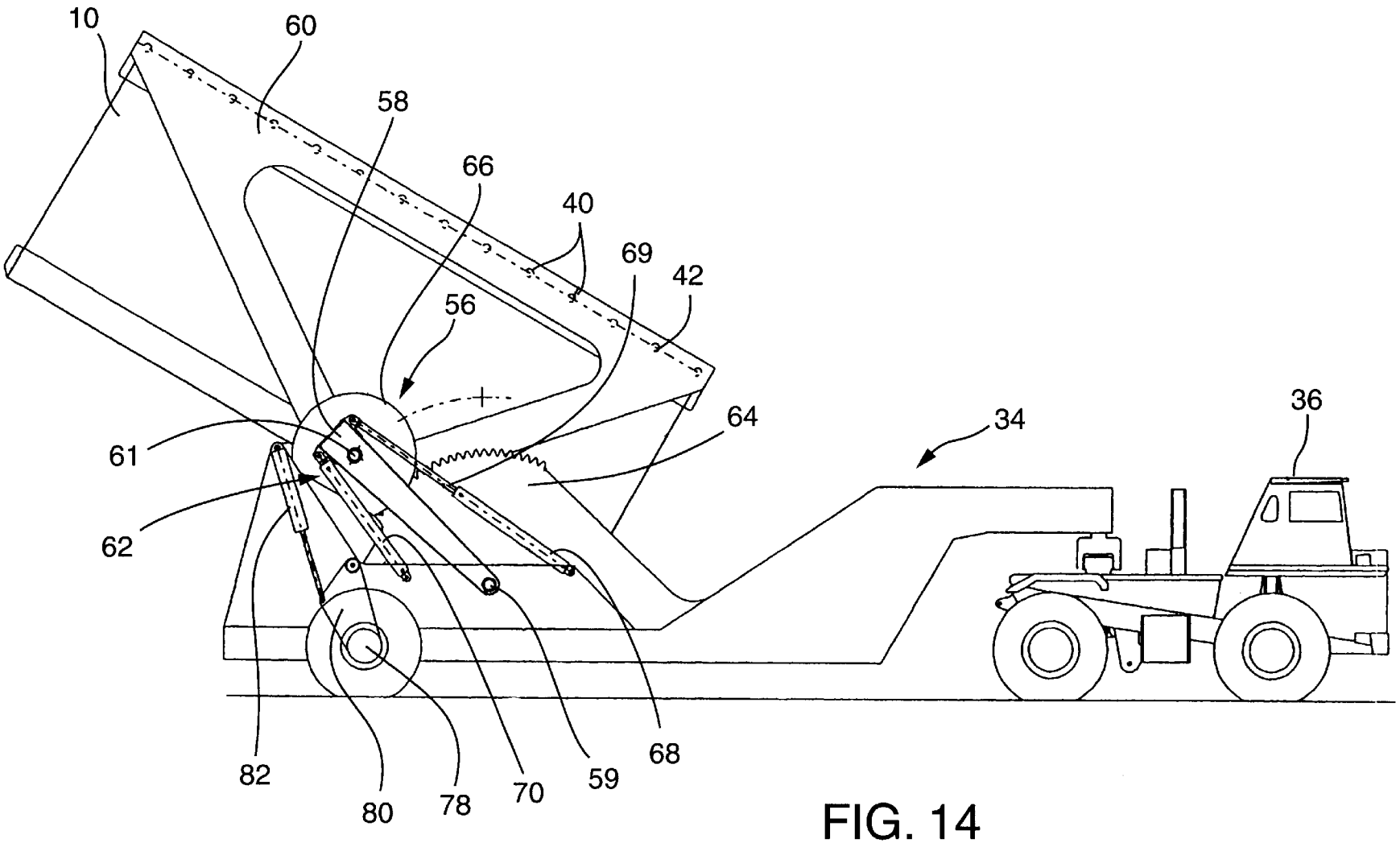
FIG. 14 illustrates the specialized container handler trailer of FIG. 11 dumping the container by rotating the container, causing the bulk material to unload from the container through its open top.
Figure 15:
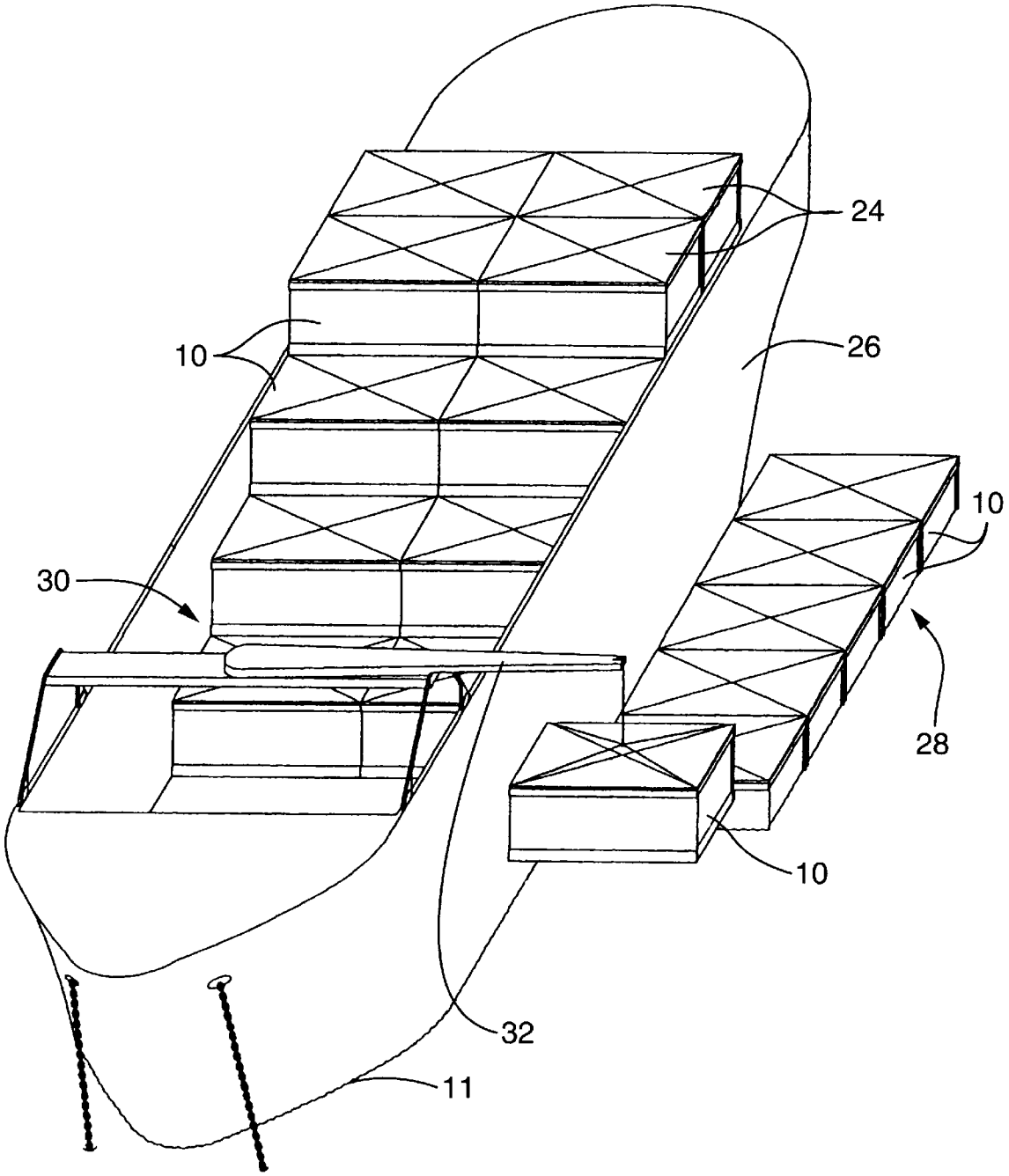
FIG. 15 illustrates the oceangoing ship lifting empty containers from the water after their load has been dumped on-shore, with several of the empty containers tied along side the ship waiting to be lifted into the hold of the ship.

Once the floating container 10 is loaded into the container cradle and locked into position via the locking assemblies 44, the container handler trailer 34 may be used to transport the floating container 10 to the desired unloading or dumping site as shown in FIG. 13. The container handler trailer 34 may also be equipped with a dumping assembly 56 which allows the container handler trailer 34 to be used to dump the floating container (one side of which is shown in FIG. 14). The dumping assembly 56 includes a pair of laterally spaced upwardly extending support arms 58 (only one of which is shown in FIGS. 10–14) that are pivotally attached to either side of the container handler trailer 34 by pivot pins 59. The two support arms 58 support the container cradle 42 which is pivotally attached to the support arms 58 by two laterally spaced pivot pins 61 which are provided adjacent the apex of the sides 60 of the container cradle 42. These pivotal attachments enable the container cradle 42 to rotate about two axes into a dump position, namely the axis defined by the pivotal attachment of the support arms 58 to the container handler trailer 34 and the pivotal attachment of the cradle 42 to the support arms 58.

In order to rotate the container cradle 42 to allow the floating container 10 to be dumped via its open top, the container handler trailer 34 includes a dumping gear mechanism 62, preferably on each side of the container cradle 42. The dumping gear mechanism 62 includes a trailer gear 64 and a container cradle pinion gear 66 (actual gear teeth not shown). The trailer gear 64 comprises a partial spur gear that is fixed to the container handler trailer 34 and is arranged vertically with its teeth disposed upwardly towards the cradle pinion gear 66. The cradle pinion gear 66 is a partial pinion gear which is fixed to the container cradle 42 and adapted to engage the trailer gear 64. The dumping gear mechanism 62 also includes a pair of hydraulic cylinders 68, 70. As shown in FIGS. 13–14, the piston rod end 69, 71 of each hydraulic cylinder 68, 70 is pivotally attached near the top of the support arm 58 and the cylinder end of each hydraulic cylinder 68, 70 is pivotally attached to the trailer 34. As shown in FIG. 14, when the forward hydraulic cylinder 68 extends its piston rod 69 and the rearward hydraulic cylinder 70 simultaneously retracts its piston rod 71, it causes the support arms 58 to rotate counterclockwise (with respect to FIGS. 13–14) about pivot pins 59. The counterclockwise rotation of the arm 58 about the pivot pin 59 causes the teeth on the cradle gear 66 and the trailer gear 64 to engage thereby causing the cradle pinion gear 66 to rotate the container cradle 42 counterclockwise about the axis formed by the pivotal connection of the container cradle 42 to the arms 58. This counterclockwise rotation of both the arms 58 about the pivot pins 59 and the container cradle 42 about pivot pins 61 causes the container cradle 42 to rotate approximately 150° into a dump position as shown in FIG. 14.

Once the material 12 in the floating containers 10 has been unloaded, the empty floating containers 10 can be returned to the shore where they can be staged either in the water or on shore if a port or dock facility is available. The empty floating containers 10 can then be moved by a tugboat from the staging area back to a transport ship 26, as desired, for a return trip to the original launch point, or possibly to another location, for reuse in the shipment of other materials. It is also possible that the empty floating containers 10, once emptied, could simply be used at the destination point for shipping other materials to another location.

Figure 16:
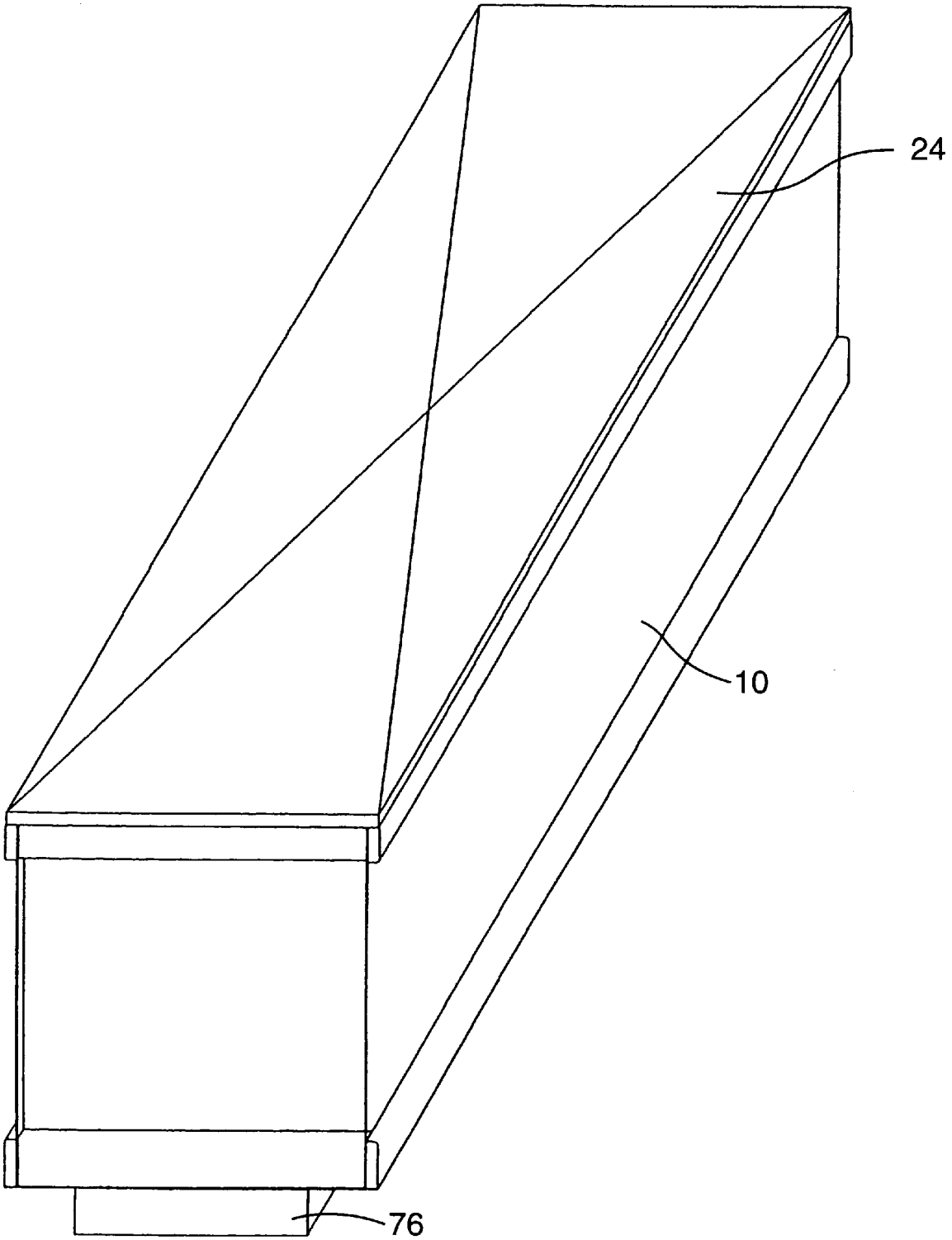
FIG. 16 illustrates a container supported by a pedestal from which it is picked up by the container handler trailer.
Figure 17:
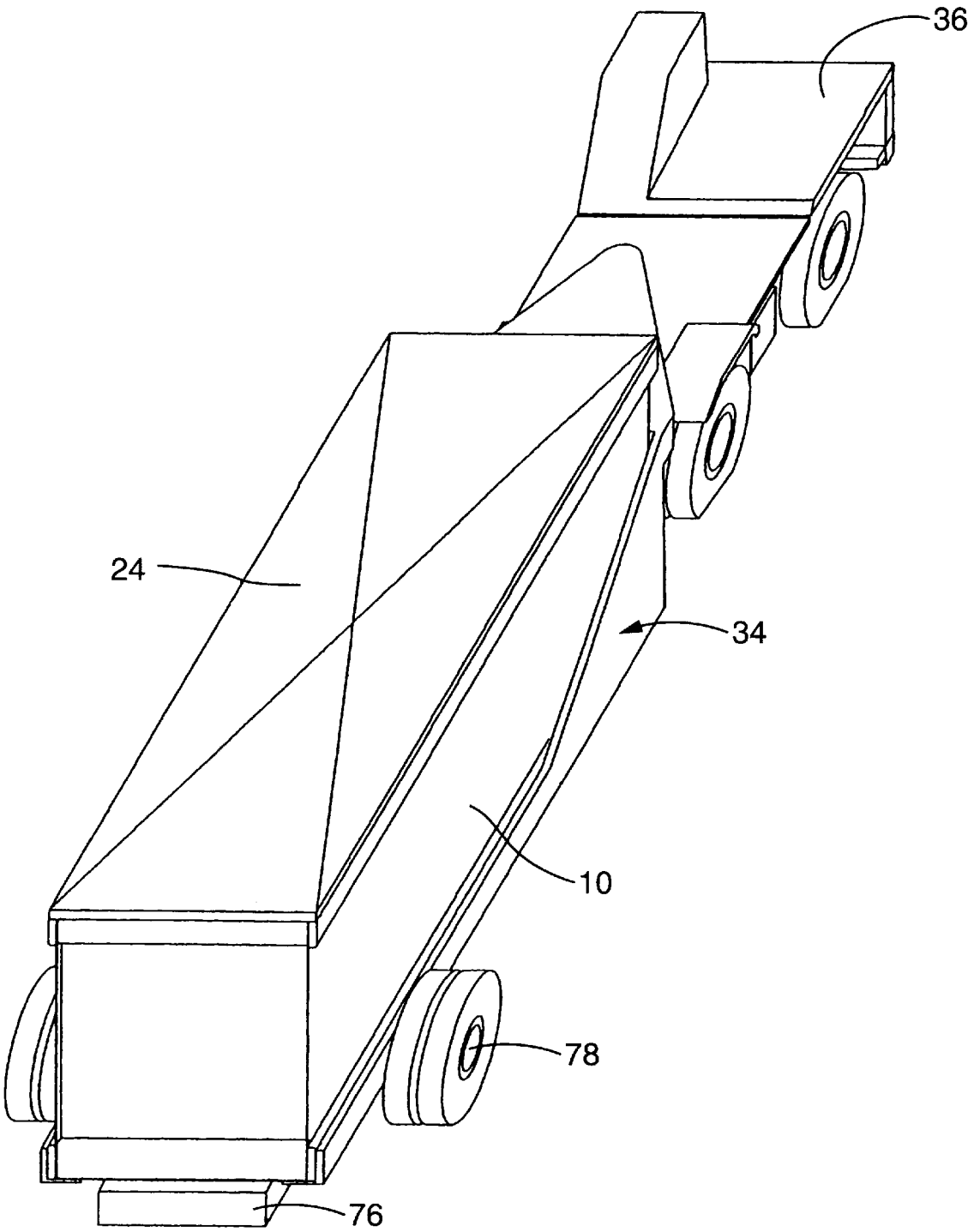
FIG. 17 is a perspective view which illustrates the container of FIG. 16 being lifted up off the pedestal and into a transport position by the container handler trailer of FIG. 11.
Figure 18A:
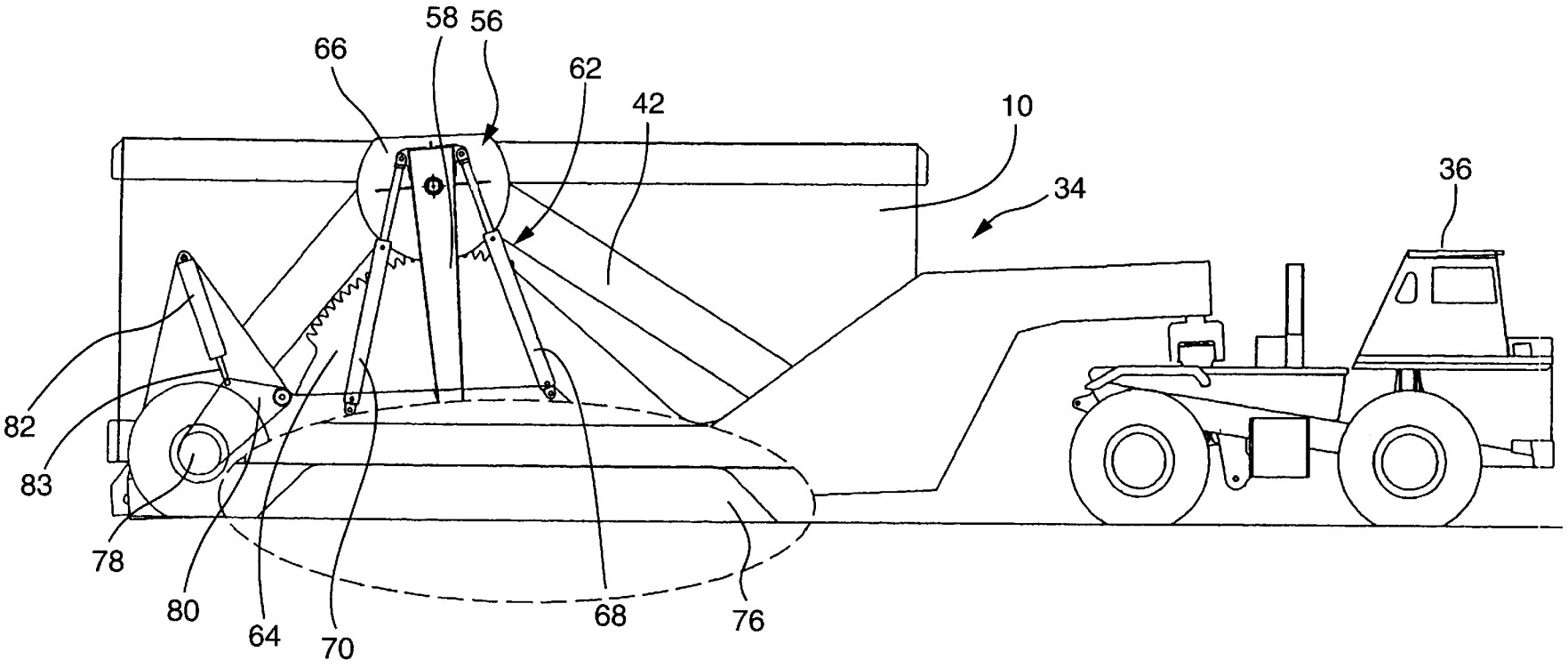
FIG. 18A is a side view which illustrates the container handler trailer with the rear axle retracted to lower the container handler trailer so that it may be backed underneath the container supported by the pedestal of FIG. 16.
Figure 18B:
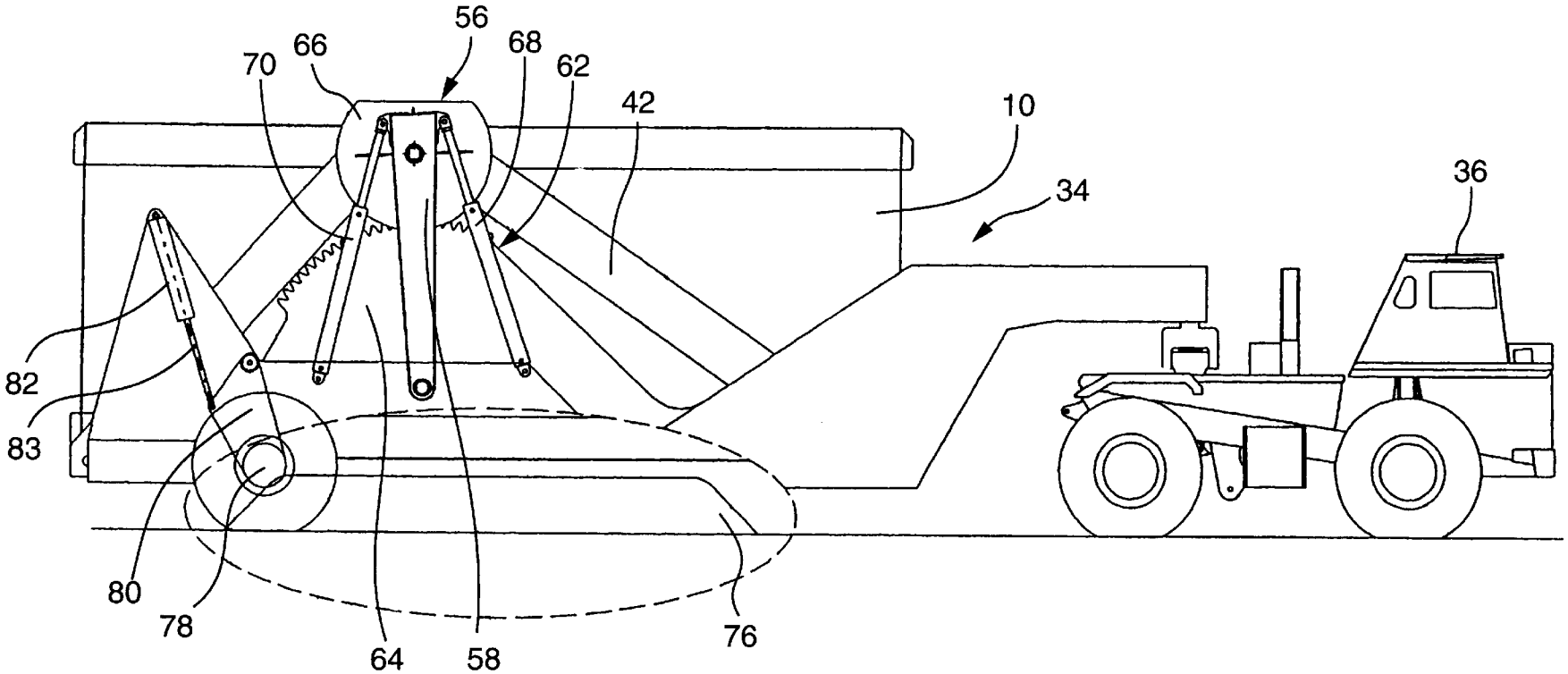
FIG. 18B is a side view which illustrates the container handler trailer with the rear axle extended to lift the container off of the pedestal of FIG. 16.

In addition, either empty or loaded floating containers 10 may be stored on land on a pedestal 76 as desired. As shown in FIG. 16, the pedestal 76 has a width which is less than the width of the container handler trailer 34. As shown in FIG. 17, this enables the container handler trailer 34 to be backed under the floating container 10 in order to pick up a container 10 from the pedestal 76 or to be backed with a container 10 over the pedestal 76 in order to drop a floating container 10 on the pedestal 76. The container handler trailer 34 is equipped with a retractable rear axle 78 which enables the trailer 34 to move to a lowered position to drop off or pick up a floating container 10 from the pedestal 76 as best shown in FIGS. 18A and 18B. In particular, the rear axle 78 is pivotally attached to the trailer 34 by a link 80. A hydraulic cylinder 82 having its barrel end fixedly attached to the trailer 34 and its rod end 83 pivotally attached to the link 80 rotates the link, and thereby the rear axle 78, between retracted (FIG. 18A) and extended (FIG. 18B) positions. The container cradle 42 has a substantially open bottom which is adapted such that the container handler trailer 34 can pick-up and drop off floating containers 10 on the pedestal 76. When picking up a floating container 10 from the pedestal 76, the rear axle 78 is first retracted by retracting the piston rod 83 and then the container handler trailer 34 is backed around the pedestal 76 as shown in FIG. 18A. Once the container handler trailer 34 is underneath the floating container 10, as shown in FIG. 18B, the rear axle 78 is extended by extending the piston rod 83 and the container handler trailer 34 lifts the floating container 10 off of the pedestal 76. The container handler trailer 34 can then be pulled away with the floating container 10. When dropping off a floating container 10 on the pedestal 76, the container handler trailer 34 is backed around the pedestal 76 with rear axle 78 in the extended position. When the floating container 10 is over the pedestal 76, the piston rod 83 is retracted in order to retract the rear axle 78 and enable the container 10 to be placed on the pedestal 76. The container handler trailer 34, with the rear axle 78 still retracted, can then be pulled out from under the container, leaving it in place on the pedestal 76. In addition, the container handler trailer 34 could be equipped with a mechanism which would enable the container handler trailer 34 to pick-up a floating container 10 from the top.

It will be understood that it is not necessary to provide a container handler trailer which is capable of both removing the floating containers 10 from the water and dumping the containers. For example, the container handler trailer may only be capable of removing the floating containers 10 from the water and transporting them inland where they are transferred to another container handler trailer for dumping or to a fixed dumping apparatus.

Thus it will be seen that a novel process for moving and transporting materials using floating containers has been provided which attains the aforementioned objects. Various additional modifications of the embodiments specifically illustrated and described herein will be apparent to those skilled in the art, particularly in light of the teachings of this invention. The invention should not be construed as limited to the specific form shown and described, but instead is set forth in the following claims.

What is claimed is:

1. A method for transporting bulk materials using containers floating in water, the method comprising: filling the containers with the bulk materials; floating the filled containers from a launching area close to a shoreline to an offshore ship capable of holding a plurality of the containers; loading the filled containers onto the ship; transporting the containers on-board the ship to an area off-shore of a landing site; floating the filled containers from the ship to the landing site; removing the containers from the water by floating each of the containers into engagement with a mobile vehicle equipped with an apparatus for carrying one or more filled containers; transporting the containers using the mobile vehicle over land to a remotely located destination and, emptying the bulk material from the filled containers at the destination.

2. The method of claim 1 wherein the step of filling the containers includes the step of filling the containers from their tops.

3. The method of claim 1 including the step of closing tops of the containers after they are filled and stacking the closed, filled containers in the offshore ship.

4. The method of claim 1 wherein the apparatus for carrying the filled containers over land is a trailer attached to a heavy-duty vehicle.

5. The method of claim 1 wherein the containers are filled while they are floating.

6. The method of claim 1 wherein the apparatus for carrying the filled containers over land to the destination rotates the container in order to top-dump the bulk materials.

7. The method of claim 1 including measuring a draft in at least one of the filled containers floating in the water in order to estimate a weight of the bulk materials held in said at least one of the filled containers.

8. The method of claim 7 including the step of applying indicia to a side of the at least one of the filled containers whose bulk material weight is to be estimated, where the indicia for each container to which they are applied cooperate with the draft of the container to provide a scale from which the weight of the bulk material held in the container can be estimated.

9. The method of claim 1 including the steps of returning the containers to the water at a re-launching site after the bulk materials have been emptied at the destination; floating the empty containers to a ship; transporting the empty containers to another destination; floating the empty containers to a landing site of the other destination.

10. The method of claim 9 wherein the other destination to which the empty containers are transported is the same place as the launching area from which the filled containers originated.

11. The method of claim 10 wherein the same place serves as the landing site to which the filled containers are floated and the re-launching site from which the empty containers are returned to the water.

12. The method of claim 1 wherein the containers are filled before they are floated in the water.

13. The method of claim 12 wherein the containers are filled at a collection site for bulk material and transported to the launching area by a vehicle that includes an apparatus for both carrying the containers over land and launching the containers into the water at the launching area.

14. The method of claim 13 wherein the apparatus includes a mechanism for lifting each of the containers from a structure that supports the container while it is being filled with the bulk materials.

15. A method for transporting bulk materials using containers floating in water, the method comprising: filling the containers with the bulk materials; floating the filled containers from a launching area close to a shoreline to an offshore ship capable of holding a plurality of the containers; loading the filled containers onto the ship; transporting the containers on-board the ship to an area off-shore of a landing site; floating the filled containers from the ship to the landing site; removing the containers from the water by floating each of the containers into engagement with a mobile vehicle equipped with an apparatus for carrying one or more filled containers; transporting the containers using the mobile vehicle over land to a destination and, emptying the bulk material from the filled containers at the destination using a dumping mechanism provided on the container carrying apparatus.

16. The method of claim 15 wherein the dumping mechanism rotates the container in order to top-dump the bulk materials.

17. The method of claim 15 wherein the step of filling the containers includes the step of filling the containers from their tops.

18. The method of claim 15 including the step of closing tops of the containers after they are filled and stacking the closed, filled containers in the offshore ship.

19. The method of claim 15 wherein the containers are filled while they are floating.

20. The method of claim 15 including measuring a draft in at least one of the filled containers floating in the water in order to estimate a weight of the bulk material held in said at least one of the filled containers.

21. The method of claim 20 including the step of applying indicia to a side of the at least one of the filled containers whose bulk material weight is to be estimated, where the indicia for each container to which they are applied cooperate with the draft of the container to provide a scale from which the weight of the bulk material held in the container can be estimated.

22. The method of claim 15 including the steps of returning the containers to the water at a re-launching site after the bulk materials have been emptied at the destination; floating the empty containers to a ship; transporting the empty containers to another destination; floating the empty containers to a landing site of the other destination.

23. The method of claim 22 wherein the other destination to which the empty containers are transported is the same place as the launching area from which the filled containers originated.

24. The method of claim 23 wherein the same place serves as the landing site to which the filled containers are floated and the re-launching site from which the empty containers are returned to the water.

25. The method of claim 15 wherein the containers are filled before they are floated in the water.

26. The method of claim 25 wherein the containers are filled at a collection site for bulk material and transported to the launching area by a vehicle that includes an apparatus for both carrying the containers over land and launching the containers into the water at the launching area.

27. The method of claim 26 wherein the apparatus for both carrying the containers over land and launching the containers into the water includes a mechanism for lifting each of the containers from a structure that supports the container while it is being filled with the bulk materials.

* * * * *